US005572805A

United States Patent [19]

Giese et al.

[11] Patent Number: 5,572,805

[45] **Date of Patent: *Nov. 12, 1996**

[54] MULTI-DENSITY SHOE SOLE

[75] Inventors: Erik O. Giese; Roger J. Brown, both of Aspen, Colo.

[73] Assignee: Comfort Products, Inc., Aspen, Colo.

[ * ] Notice: The portion of the term of this patent subsequent to Jun. 25, 2008, has been disclaimed.

[21] Appl. No.: 333,585

[22] Filed: Nov. 1, 1994

Related U.S. Application Data

[63] Continuation-in-part of Ser. No. 55,935, Apr. 30, 1993, abandoned, which is a continuation-in-part of Ser. No. 649,525, Feb. 1, 1991, abandoned, which is a continuation of Ser. No. 871,017, Jun. 4, 1986, Pat. No. 5,025,573.

[51] Int. Cl.[6] ..... A43B 13/12; A43B 13/14

[52] U.S. Cl. ..... 36/30 R; 36/31; 36/25 R; 36/103; 36/92; 36/107; 36/22 A; 36/76 C

[58] Field of Search ..... 36/30 R, 31, 28, 36/32 R, 25 R, 103, 92, 82, 107, 108, 76 R, 76 C, 22 A, 11.5

[56] References Cited

U.S. PATENT DOCUMENTS

| | | | |
|---|---|---|---|
| Re. 31,173 | 3/1983 | Daswick | 36/30 R |
| 1,701,611 | 2/1929 | Glidden et al. | 36/30 R |
| 1,711,788 | 5/1929 | Incutti | 36/76 R |
| 1,993,208 | 3/1935 | Cohn | 36/76 R |
| 2,217,341 | 10/1940 | Kamborian et al. | 36/31 |
| 2,410,019 | 10/1946 | Davis | 36/28 |
| 2,457,481 | 12/1948 | MacArthur | 36/76 R |
| 3,824,716 | 7/1974 | Di Paolo | 36/32 R |
| 4,020,569 | 5/1977 | Fukuoka | 36/29 |
| 4,124,946 | 11/1978 | Tomlin | 36/30 R |
| 4,128,950 | 12/1978 | Bowerman et al. | 36/30 R |
| 4,130,947 | 12/1978 | Denu | 36/30 R |
| 4,302,892 | 12/1981 | Adamik | 36/31 |
| 4,316,332 | 2/1982 | Giese et al. | 36/30 R |
| 4,335,530 | 6/1982 | Stubblefield | 36/83 |
| 4,348,821 | 9/1982 | Daswick | 36/103 |
| 4,354,318 | 10/1982 | Federick et al. | 36/30 R |
| 4,364,188 | 12/1982 | Turner et al. | 36/31 |
| 4,364,189 | 12/1982 | Bates | 36/31 |
| 4,366,629 | 1/1983 | Scherz | 36/76 R |
| 4,377,041 | 3/1983 | Azchermes | 36/30 R |
| 4,398,357 | 8/1983 | Batra | 36/30 A |
| 4,399,620 | 8/1983 | Funck | 36/30 R |
| 4,418,483 | 12/1983 | Fujita | 36/28 |
| 4,439,937 | 4/1984 | Daswick | 36/30 R |
| 4,446,633 | 5/1984 | Scheinhaus et al. | 36/11.5 |
| 4,449,306 | 5/1984 | Cavanagh | 36/30 R |
| 4,455,765 | 6/1984 | Sjosward | 36/30 R |
| 4,490,928 | 1/1985 | Kawashima . | |
| 4,494,322 | 1/1985 | Klagmann | 36/28 |
| 4,498,251 | 2/1985 | Shin | 36/30 R |
| 4,547,979 | 10/1985 | Harada et al. | 36/31 |
| 4,561,140 | 12/1985 | Graham et al. | 36/30 R |
| 4,561,195 | 12/1985 | Onada et al. | 36/31 |
| 5,025,573 | 6/1991 | Giese et al. | 36/30 R |

FOREIGN PATENT DOCUMENTS

| | | | |
|---|---|---|---|
| 1108042 | 1/1956 | France | 36/76 R |
| 2522482 | 9/1983 | France . | |
| 2553636 | 4/1985 | France . | |
| 2643237 | 4/1978 | Germany | 36/30 R |
| 8319661 | 1/1984 | Germany . | |
| 3347343 | 7/1985 | Germany . | |
| 283034 | 5/1952 | Switzerland | 36/82 |
| 2007081 | 5/1979 | United Kingdom | 36/30 R |

*Primary Examiner*—Bryon P. Gehman
*Assistant Examiner*—Marie Denise Patterson
*Attorney, Agent, or Firm*—Pennie & Edmonds

[57] ABSTRACT

A composite shoe bottom is disclosed comprising a lower layer of firm material and an upper softer layer superposed thereon. Each layer has an upper contoured surface such that the total compressibility of the shoe bottom, as determined by the relative thicknesses of the layers, is predetermined and differs along the surface. The upper layer has an uppermost surface which is shaped to fit against and be complemental to the bottom of the foot of a wearer.

40 Claims, 37 Drawing Sheets

17
18
19
21
22
23
24
2
3
4
7
8
9

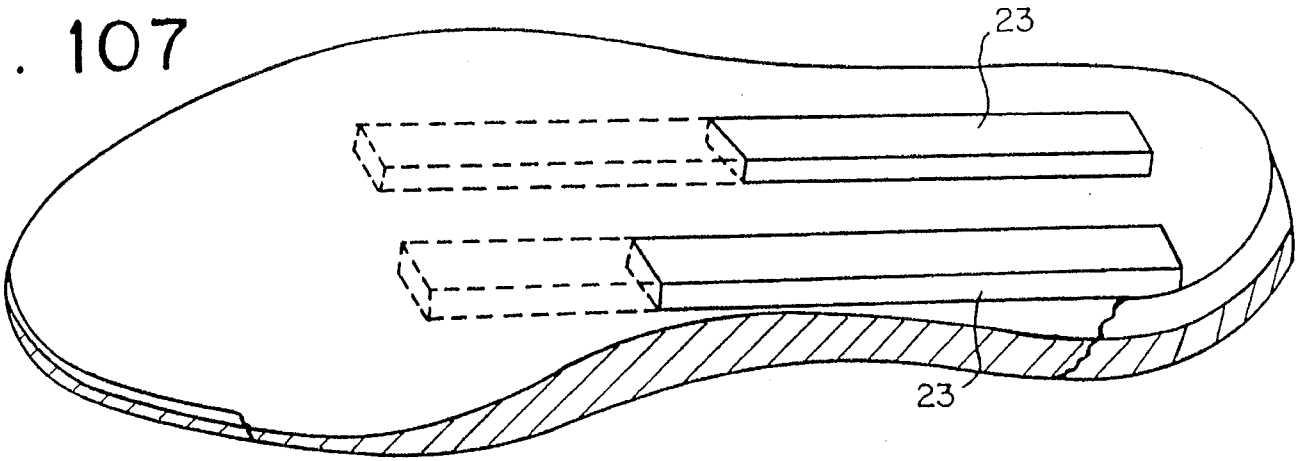
FIG. 107
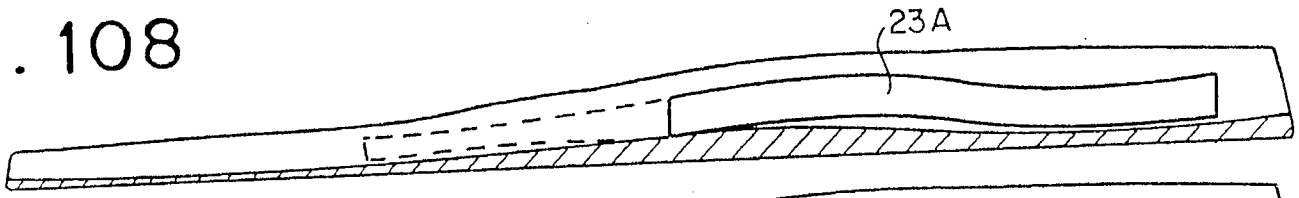
FIG. 108
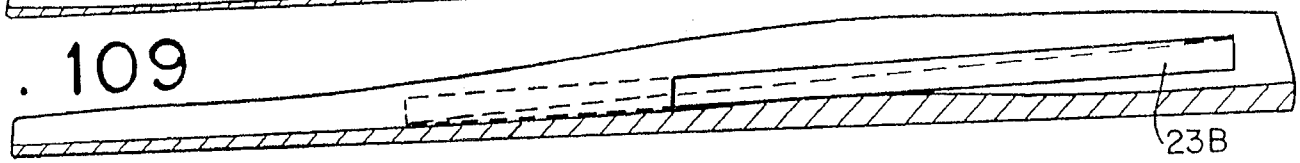
FIG. 109
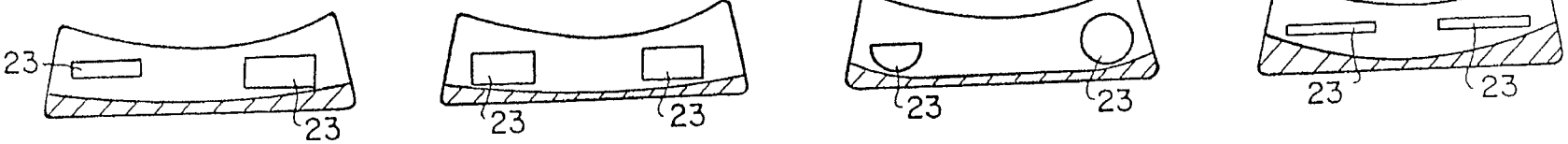
FIG. 110 D
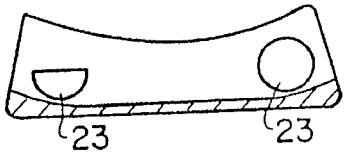
FIG. 110 C
FIG. 110 B
FIG. 110 A

MULTI-DENSITY SHOE SOLE

This is a continuation of application Ser. No. 08/055,935, filed Apr. 30, 1993, now abandoned, which is a continuation-in-part of application Ser. No. 07/649,525, filed Feb. 1, 1991, now abanoned, which is a continuation of application Ser. No. 06/871,017, filed Jun. 4, 1986, now U.S. Pat. No. 5,025,573.

FIELD OF THE INVENTION

The invention relates to shoes and in particular to shoes having sole portions formed of substances having two or more density-resilience qualities.

DESCRIPTION OF THE RELATED ART

Historically, shoe bottoms have consisted primarily of flat surfaces on both their top and bottom. These bottoms were normally made of single density polyurethane (PU) or blown polyvinylchloride (PVC) type material. The upper of the shoe would be glued onto the top of the sole or the upper could be "direct attached" through a molding process which would capture the upper in the molded sole. The bottom could be the lowermost layer of the sole if the urethane was sufficiently abrasion resistant, or alternatively a rubber outsole would be cemented onto the unit bottom, as is typically done in running shoes.

Eventually, it became known to contour the top surface of the unit bottom to provide a heel cup and slight arch. This made the shoe more comfortable because the foot would rest on a surface similar to its shape as opposed to a flat surface which felt like flat feet on a firm floor.

When the contour surface is used with a dual-density bottom, that is two different densities of PU, the lowermost (outer) portion is formed of a uniform thickness. This portion is chosen for its abrasion resistance. The softer portion is positioned on top of this uniform portion to provide comfort and cushioning as the firmer material would be too hard for comfort. Further, the respective volumes of the softer and firmer materials are such that the volume of soft material is maximized and the volume of firmer material is minimized.

The prior known structures have always had to trade cushioning for stability. If the bottom is soft for good cushioning, then the foot rocks from side-to-side and this is unstable. Even existing soles with contoured top-most surfaces have this type of trade-off.

It has been proposed, for example, in U.S. Pat. No. 4,399,620 to Herbert Funck and U.S. Pat. No. 4,446,633 to Scheinhaus et al. to contour the lower wear-resistant layer but provide a relatively flat second layer which is deformable rather than double contoured. Each of these designs, however, provides a flat surface which must be deformed by the foot to obtain a satisfactory shape, thus losing much of the support which was to be provided by the bottom.

SUMMARY OF THE INVENTION

The shoe bottom of the present invention provides double contouring in the firmer wear-resistant layer and in the softer second layer of the bottom. One advantage to this structure resides in the firmer material providing support unavailable when the softer portion is too thick. This permits soft comfort next to the foot while still providing firm support to prevent excess pronation. By forming the bottom so the firmer material rises toward the edges, lateral stability is provided while allowing cushioning where it is needed such as under the heel and ball of the foot areas. Arch support may be provided by the firmer material in a more efficient manner than merely thickening the upper soft portion.

The composite shoe bottom of the present invention has a lower shaped layer with an increased height around the heel area and in the arch area. This forms an upper stabilizing surface for the wearer's foot. An upper cushioning layer, which is softer than the lower layer, is superposed in face-to-face relation upon the upper surface of the lower layer. The upper layer has a varying thickness to define an uppermost surface which is shaped to a contour complementary to the bottom surface of the wearer's foot.

In the shoe bottom of the invention, the composite of the firmer wear-resistant layer and the softer second layer of the shoe bottom creates a combined flexibility of the shoe bottom. The two layers may not have the same shape to their upper surface. By varying the portion of the shoe bottom thickness that each layer makes up, a total elasticity or compression which changes with position is obtained. Thus, a shoe is formed providing cushioning where needed and stability where needed.

In a further embodiment of the invention the shoe bottom is provided with an internal stiffener member. The stiffener member or internal comfort stabilizer provides an amount of rigidity to part of the shoe bottom so it flexes at the metatarsal region and not further back toward the heel. This type of structure provides a light weight shoe bottom without sacrificing the necessary stiffness in the portion of the shoe bottom from in front of the arch back to the heel.

The top surface of the stiffener member may be flat or contoured to provide stabilizing support to the upper contoured layer. This contoured surface is especially advantageous in rugged type applications of footwear. In women's footwear the member is extremely advantageous for use in high-heeled shoes. The high heel requires very strong support over a very long distance.

The stiffener member is insertion molded with the shoe bottom and is thereby securely mounted within the shoe bottom.

In a further embodiment a multiple number of stabilizers are insertion molded into the shoe bottom. The stabilizers may run across the shoe bottom with flex portions in between. This provides for torsional rigidity with flexibility about the ball of the foot. The stabilizers may have a T-shaped cross-section for additional strength; the lower layer may have upward projections to hold the stabilizer while the soft layer is molded into the shoe bottom.

BRIEF DESCRIPTION OF THE DRAWINGS

FIG. 107 is a perspective view, partially broken away, of a further embodiment of the stabilizer;

FIG. 108 is a longitudinal cross-section showing an embodiment of FIG. 107;

FIG. 109 is a longitudinal cross-section showing an alternate embodiment of FIG. 107;

FIG. 110 is transverse cross-sectional views showing alternate shapes of the stabilizer;

FIG. 120 is a transverse cross-section along lines 120—120 of FIG. 117;

FIG. 121 is a transverse cross-section along lines 121—121 of FIG. 117;

FIG. 122 is a perspective view showing transverse stabilizers for torsional rigidity;

FIG. 123 is a longitudinal cross-section along lines 123—123 of FIG. 122;

FIG. 124 is a transverse cross-section along lines 124—124 of FIG. 122;

FIG. 125 is a transverse cross-section along lines 125—125 Of FIG. 122;

FIG. 126 is a transverse cross-section along lines 126—126 of FIG. 122;

FIG. 127 shows a full-length version of the stablizer;

FIG. 128 is a longitudinal cross-section along lines 128—128 of FIG. 127;

FIG. 129 is a transverse cross-section along lines 129—129 of FIG. 127;

FIG. 130 is a transverse cross-section along lines 130—130 of FIG. 127;

FIG. 131 is a transverse cross-section along lines 131—131 of FIG. 127;

Figure 132:
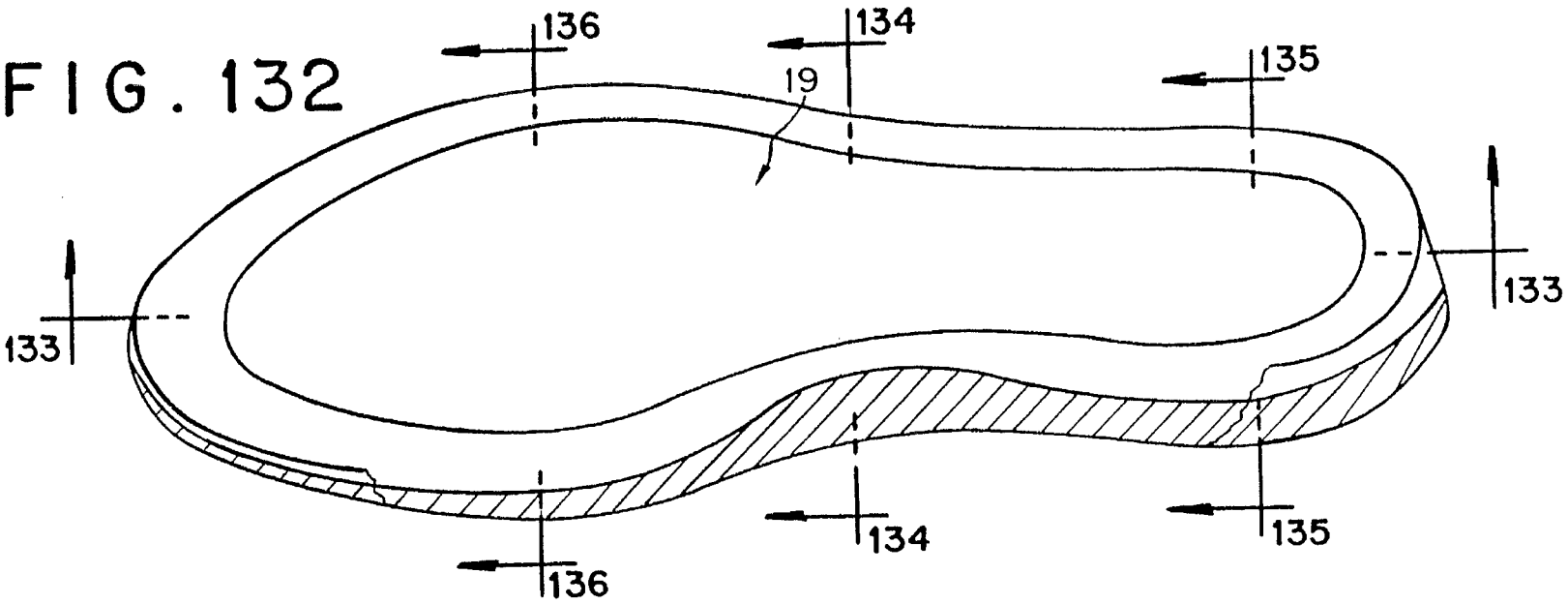
Figure 133:
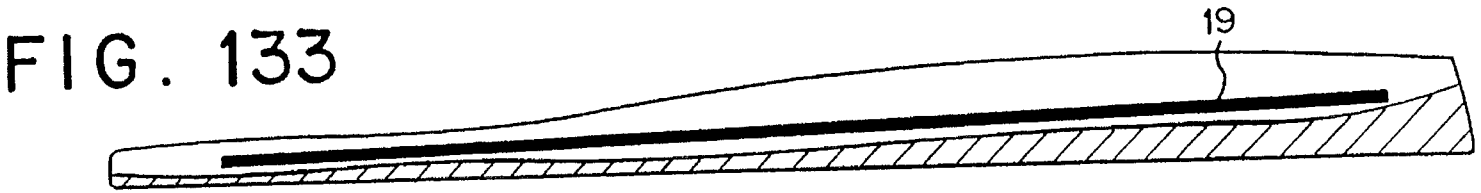
Figure 135:
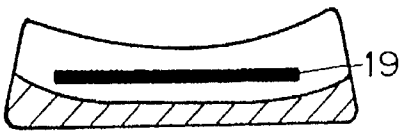
Figure 134:
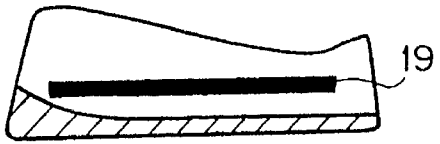
Figure 136:
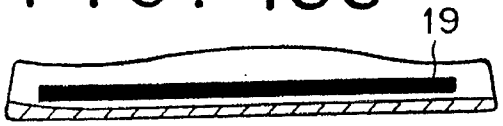
Figure 137:
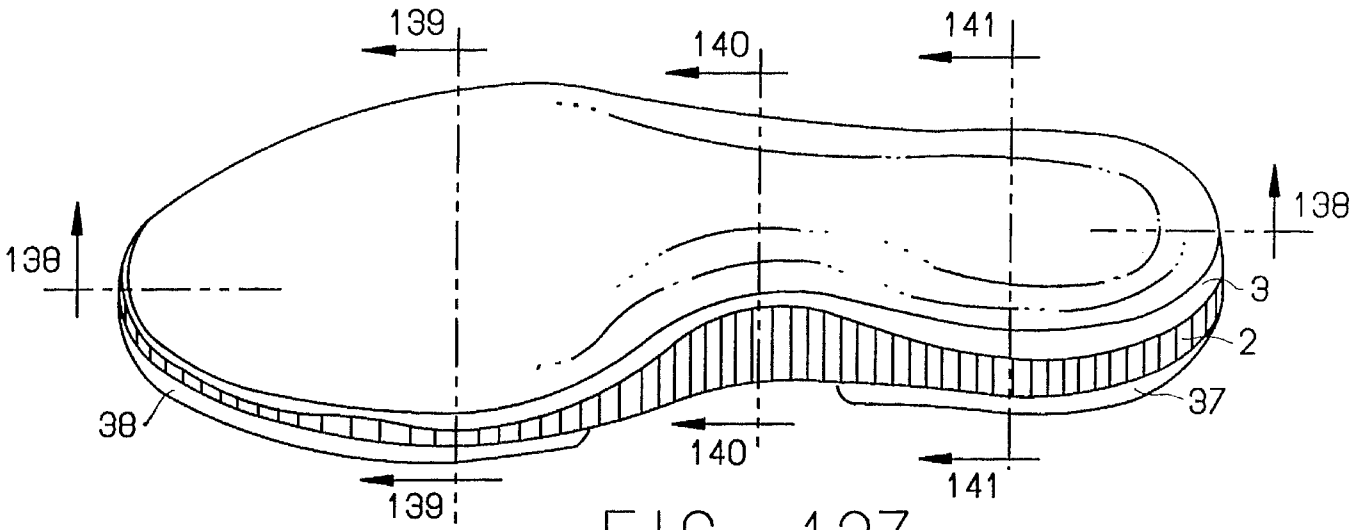
Figure 141:
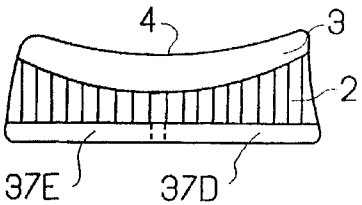
Figure 140:
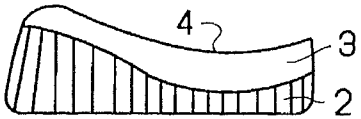
Figure 139:
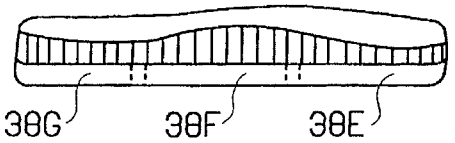
Figure 142:
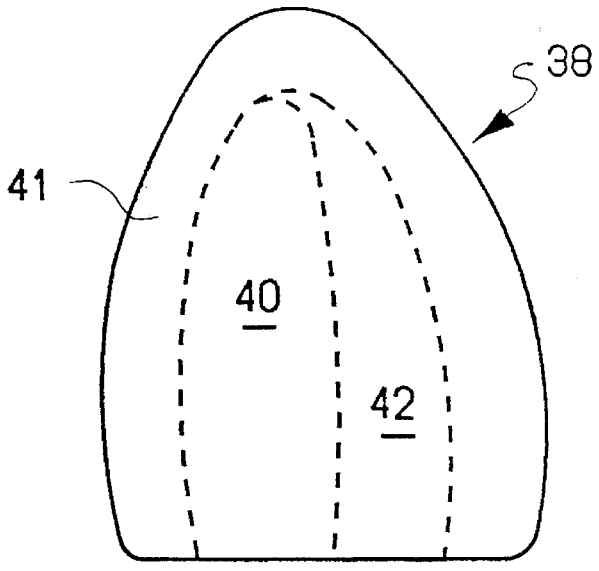
Figure 143:
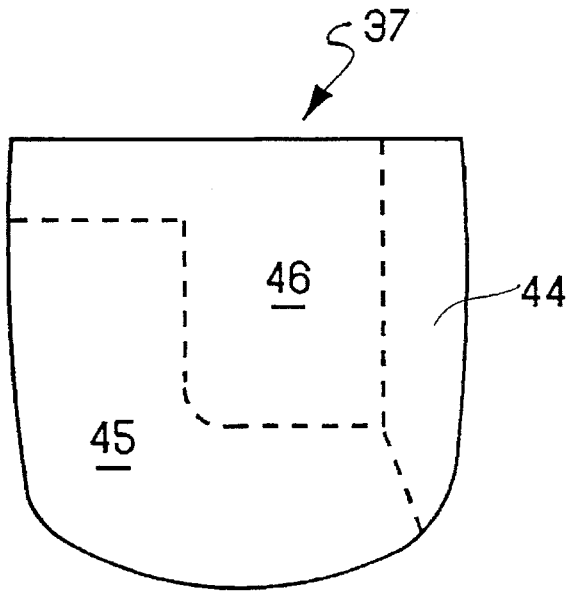
Figure 144:
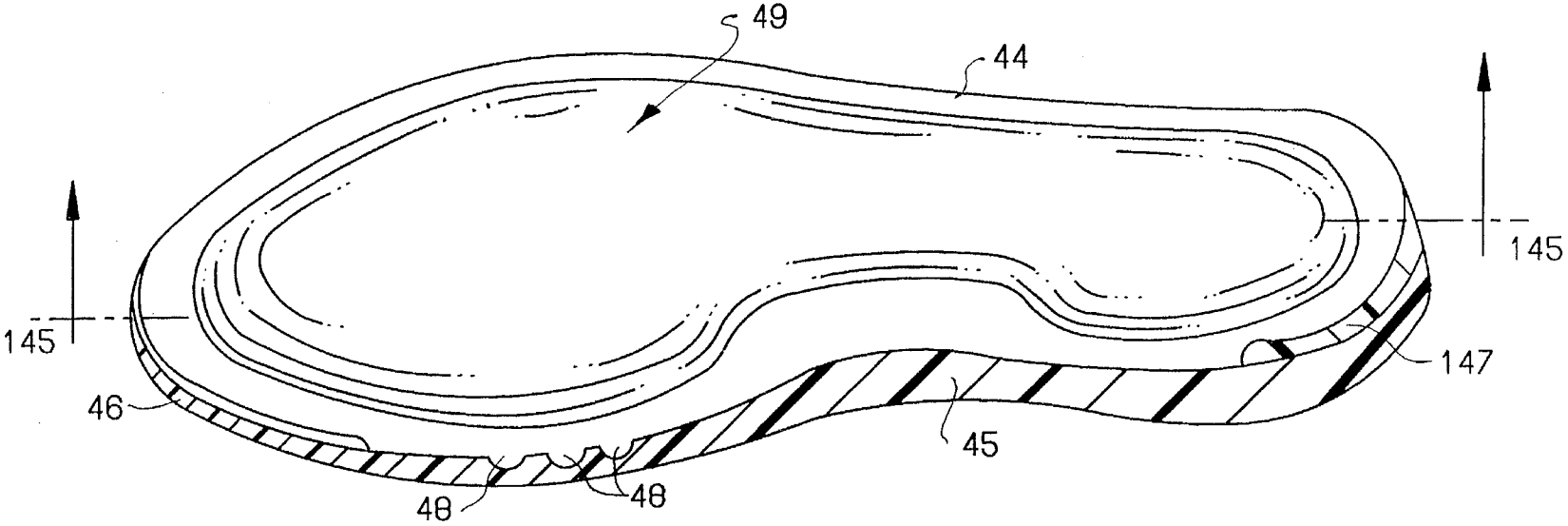
Figure 145:
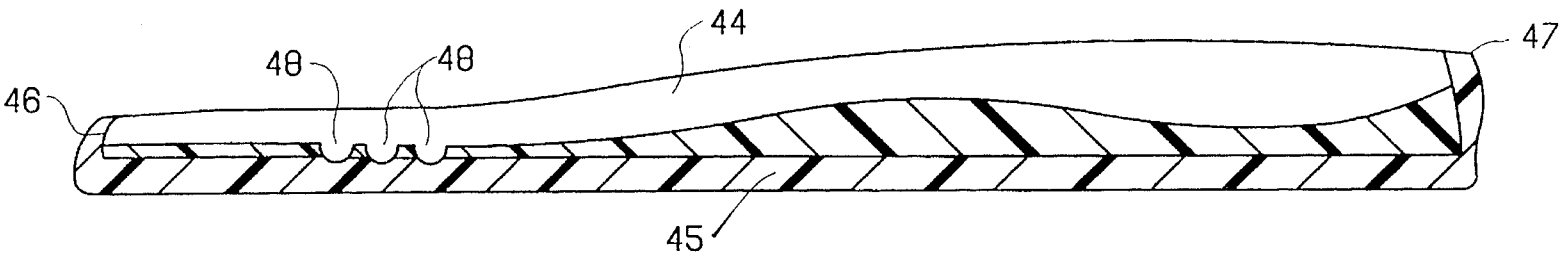
Figure 146:
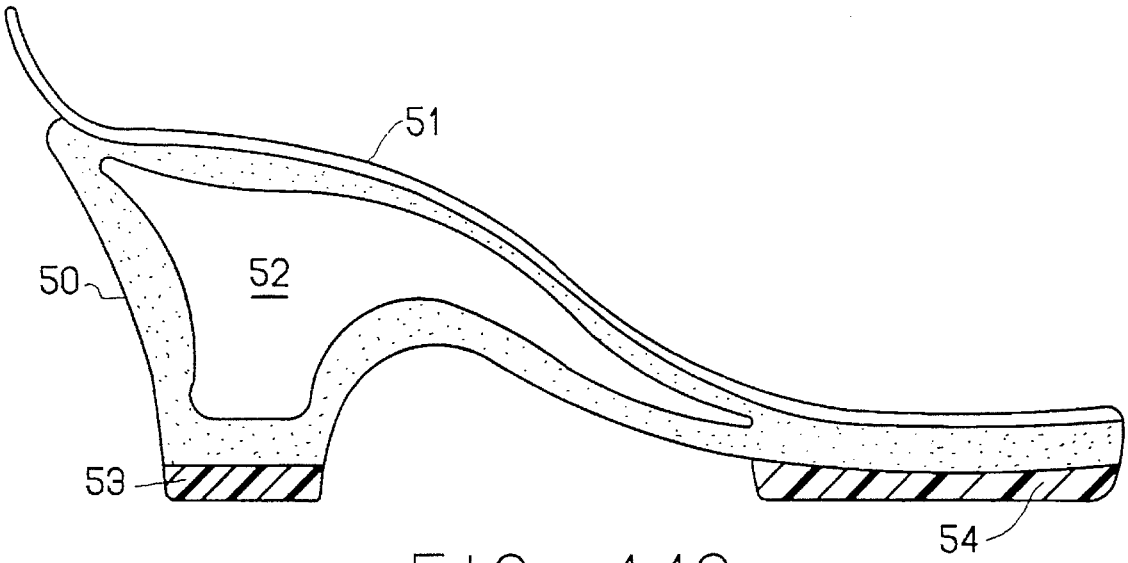
Figure 147:
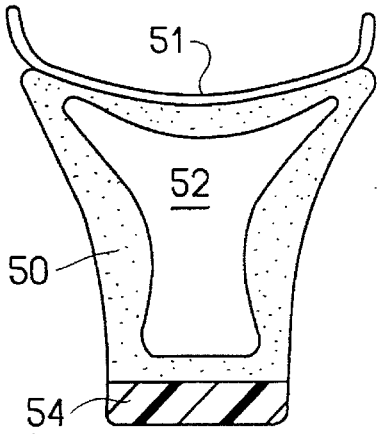
Figure 148:
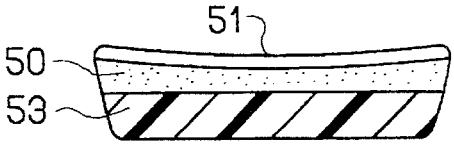
Figure 149:
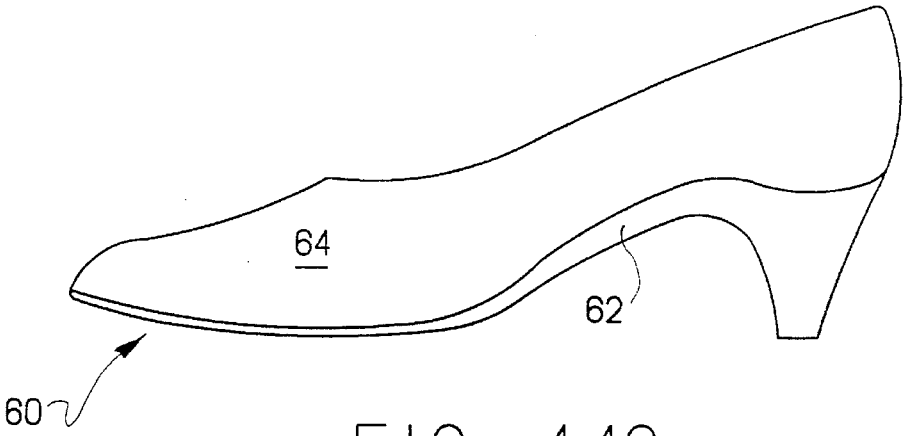
Figure 150:
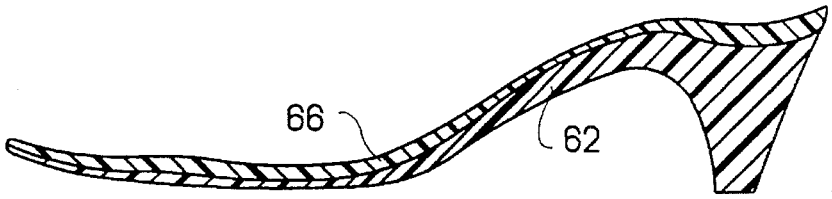
Figure 151:
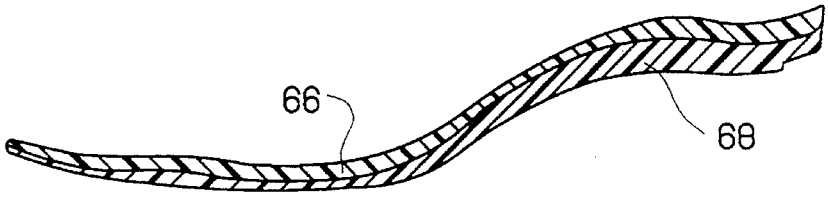
Figure 152:
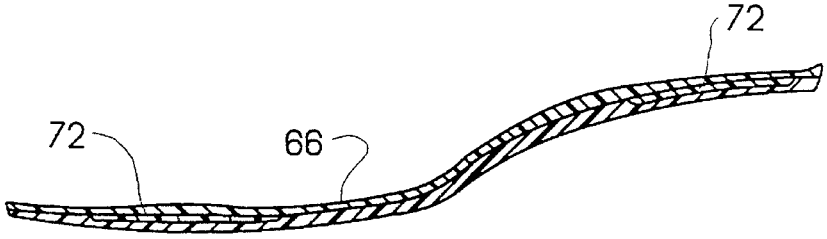
Figure 153:
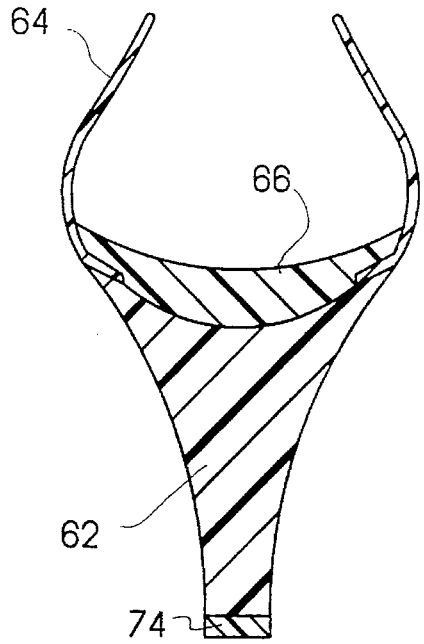
Figure 154:
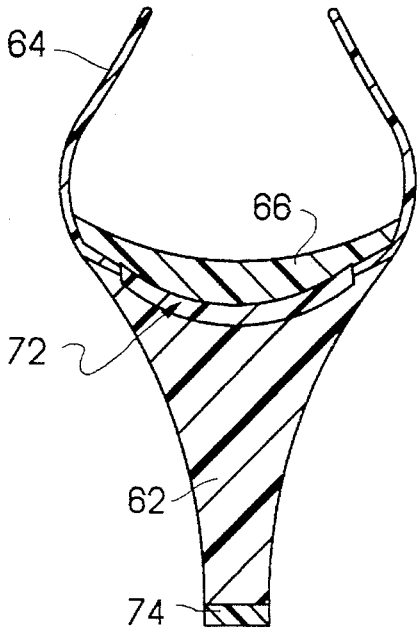
Figure 155:
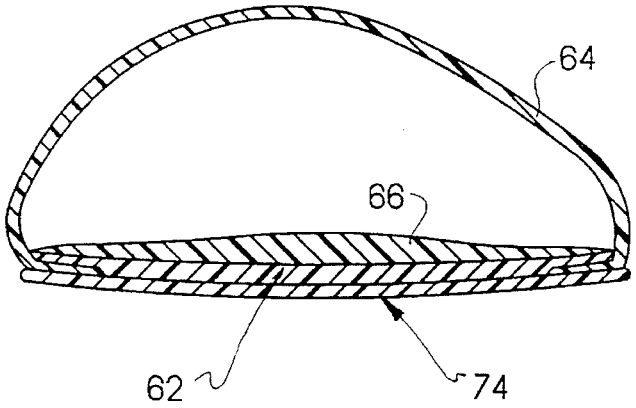
Figure 156:
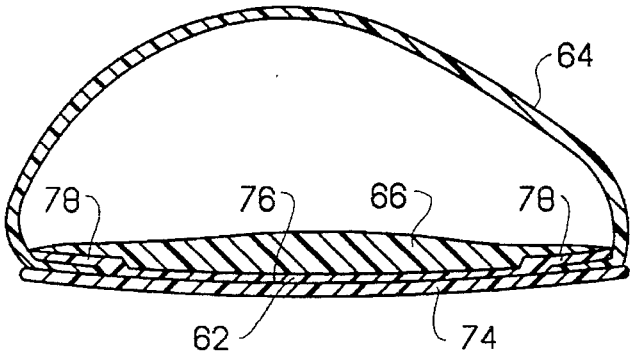
Figure 157:
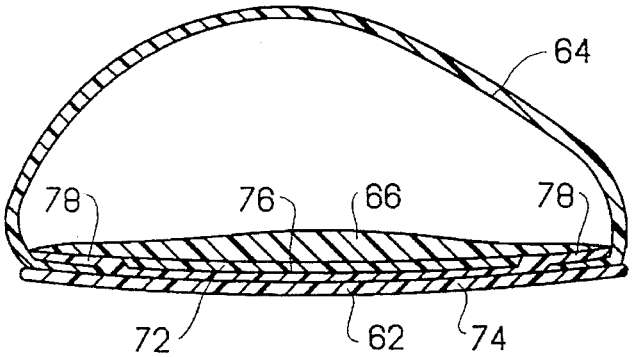

FIG. 132 is a perspective view of a full-length stabilizer for low flexibility applications;

FIG. 133 is a longitudinal cross-section along lines 133—133 of FIG. 132;

FIG. 134 is a transverse cross-section along lines 134—134 of FIG. 132;

FIG. 135 is a transverse cross-section along lines 135—135 of FIG. 132;

FIG. 136 is a transverse cross-section along lines 136—136 of FIG. 132;

FIG. 137 is a perspective view of another embodiment of the invention;

FIG. 136 is a transverse cross-section along lines 138—138 of FIG. 137;

FIG. 139 is a transverse cross-section along lines 139—139 of FIG. 137;

FIG. 140 is a transverse cross-section along lines 140—140 of FIG. 137;

FIG. 141 is a transverse cross-section along lines 141—141 of FIG. 137;

FIG. 142 is a bottom view of an alternative design for the heel of the shoe of FIG. 137;

FIG. 143 is a bottom view of an alternative design for the toe portion of the shoe of FIG. 137;

FIG. 144 is a perspective view of yet another embodiment of the invention;

FIG. 145 is a transverse cross-section along lines 145—145 of FIG. 144;

FIG. 146 is a perspective view of yet another embodiment of the invention;

FIG. 147 is a transverse cross-section along lines 147—147 of FIG. 146;

FIG. 148 is a transverse cross-section along lines 148—148 of FIG. 146;

FIG. 149 is a side view of a double contour, double density ladies' dress shoe which is constructed in accordance with the present invention;

FIGS. 150–152 are longitudinal sectional views of three alternative embodiments for the shoe of FIG. 149;

FIGS. 153–154 are lateral sectional views taken accross the width of the shoes of FIGS. 151–152 at the heel thereof; and FIGS. 155–157 are lateral sectional views taken along the length of the shoe of FIG. 149 at the forefront thereof for the three embodiments of FIGS. 150–152.

DESCRIPTION OF THE EMBODIMENTS

Figure 1:
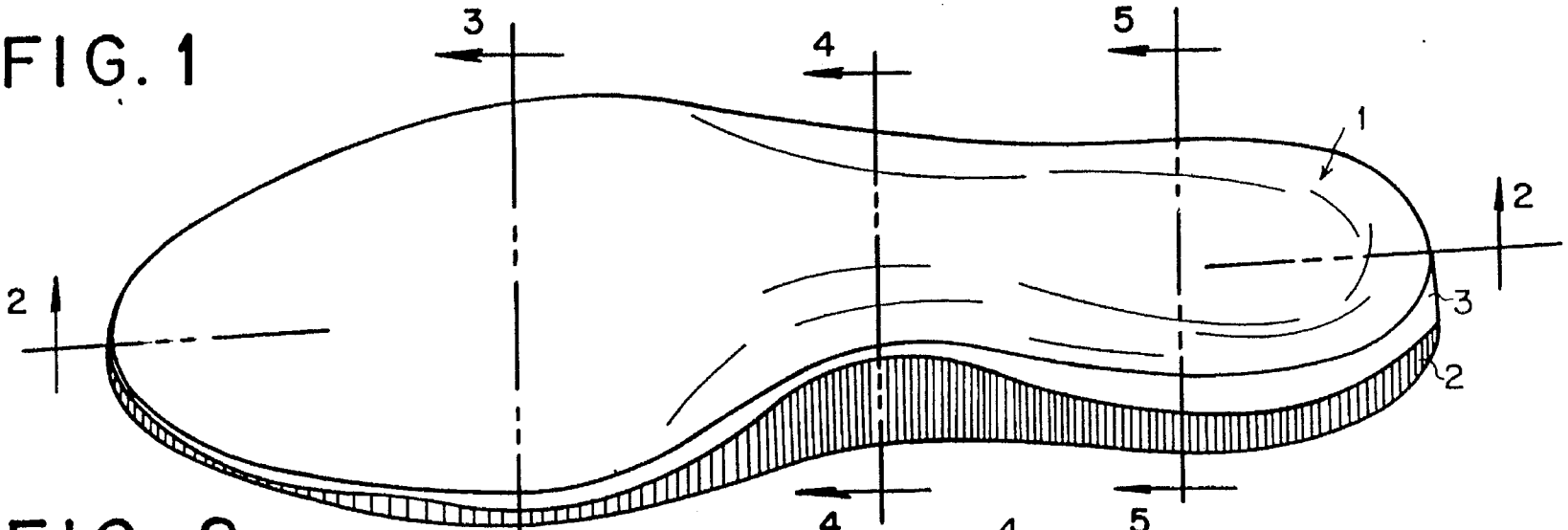
FIG. 1 is a perspective view of the composite shoe bottom of the invention.
Figure 2:
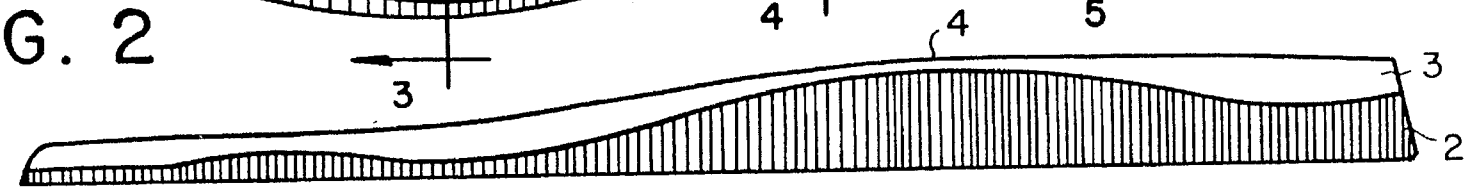
FIG. 2 is a longitudinal cross-section of the shoe bottom of FIG. 1.
Figure 3:
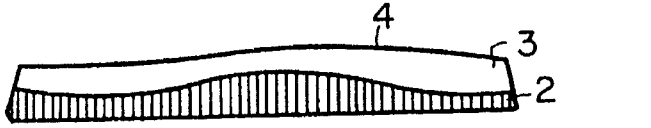
FIG. 3 is a transverse cross-section along lines 3—3 of FIG. 1.
Figure 4:
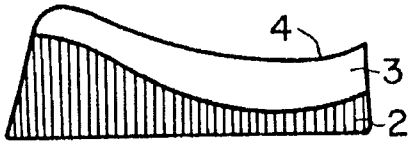
FIG. 4 is a transverse cross-section along lines 4—4 of FIG. 1.
Figure 5:
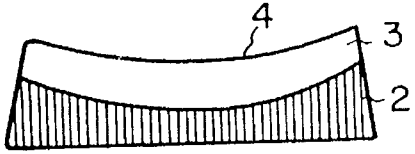
FIG. 5 is a transverse cross-section along lines 5—5 of FIG. 1.

Referring to FIG. 1, there is shown the composite shoe bottom 1 according to the invention. A firm lower layer 2 is shaped to be thicker in areas where the wearer's foot will need extra support. The softer upper layer 3 is in face-to-face engagement with the upper surface of the lower layer 2. The upper layer 3 has an uppermost surface 4 which is contoured to be complemental to the shape of a human foot bottom. As can be seen in FIG. 2, the softer layer is thinnest in the area needing the most support; for example, where the heel of the foot will rest (FIG. 5). This feature is further shown in FIGS. 3–5. As can be seen, support for the ball of the foot (FIG. 3) is relatively uniform, but the bulge of firmer material in the lower layer provides a flex axis which assists in propulsion by providing a built-in rocker function. This further supplies a metatarsal arch support. However, the arch (FIG. 4) is usually provided with a thick firm portion 2 and relatively thin softer portion 3 in the area directly beneath the arch. This relationship changes across the shoe bottom away from the arch until, as shown at the right of FIG. 4, the softer upper layer and lower layer are approximately equal in thickness. The relative thicknesses may be changed to provide a thicker soft layer and thinner firm layer. This saves weight in running shoes. The heel portion (FIG. 5) has a cup shape provided in the lower layer and less drastic cup shape of the softer layer in composite. This shoe bottom provides extra firmness and support on the outside edges of the heel to prevent pronation and supination or side-to-side rocking and instability. At the same time, the inner area of the heel is softer because the upper soft layer is thicker. This softens the impact on the heel during walking or running. This further forces the foot's fatty tissue inward beneath the heel to assist the shock absorbing function of the fatty tissue.

The two sole pieces may be preformed and glued or ultrasonically welded to one another. However, it is more convenient to mold the softer layer directly onto the firmer lower layer. When molded together, the heat of molding the second layer causes attachment of the two layers.

The shaped lower layer has a predetermined hardness which is capable of maintaining its shape against the wearer's weight. The predetermined hardness permits the layer to flex, move and distort under the weight without permanently deforming. The upper layer is similarly made of a material that does not permanently deform.

Currently known dual density polyurethane polymers have a range of density from a soft 0.25 to a more dense 1.1. The hardness of the layers is expressed in terms of the Shore "A" hardness scale. The softer upper layer ranges in shore hardness between 25 and 40. The firmer lower layer has a hardness range from 50 to 75. The softer layer, however, could go as soft as 25 with a density of 0.25, because of the support provided by the lower layer.

Figure 11:
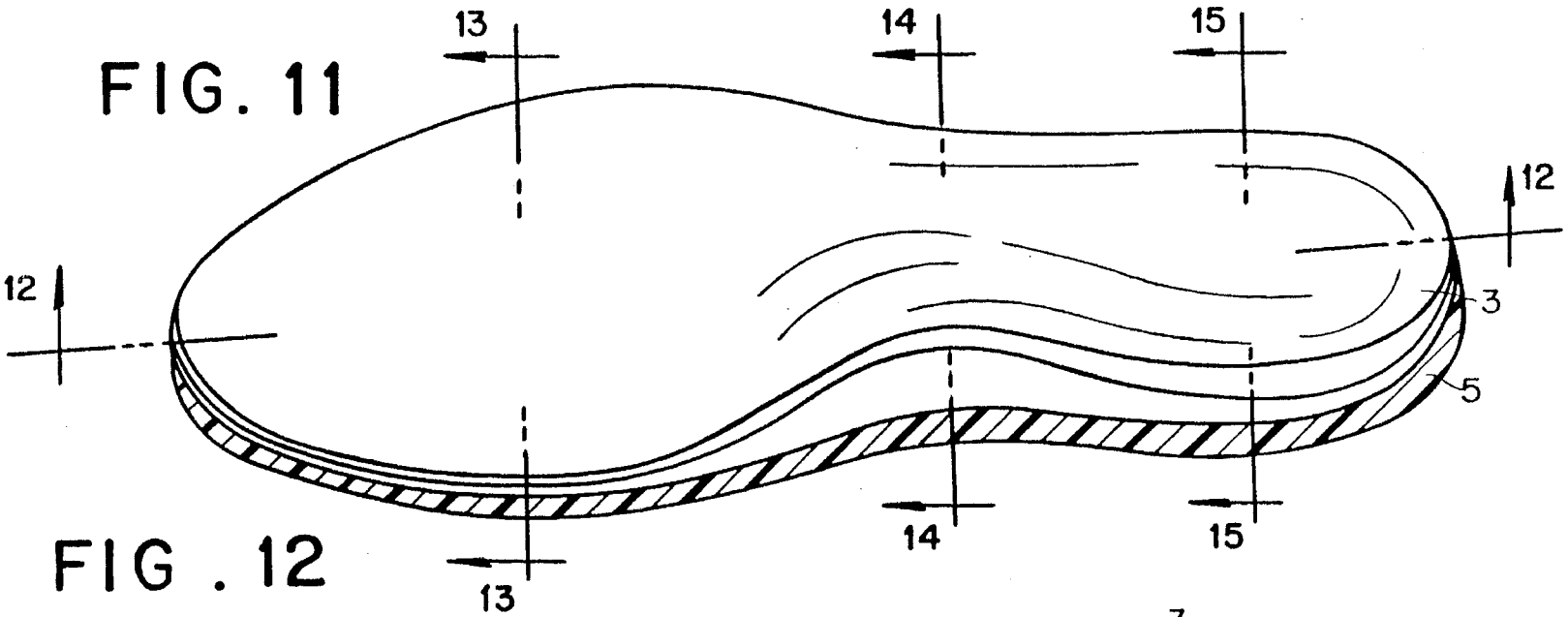
FIG. 11 is a cross-sectional view of an embodiment of the invention with three layers.
Figure 12:
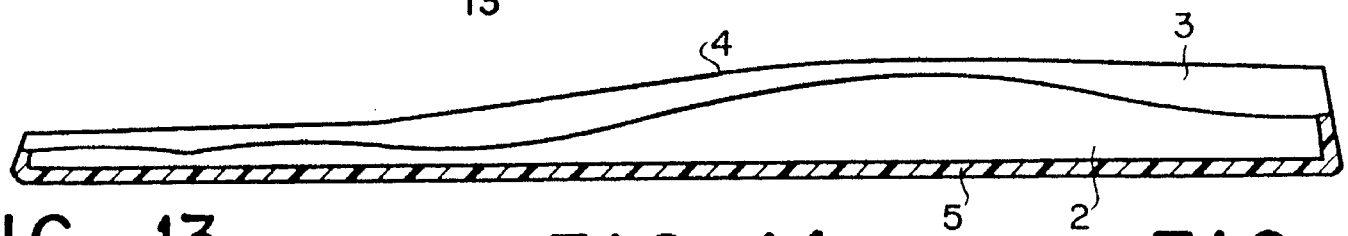
FIG. 12 is a longitudinal cross-section along lines 12—12 of FIG. 11.
Figure 14:
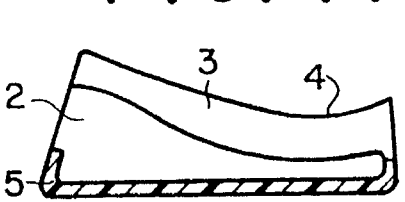
FIG. 14 is a transverse cross-section along lines 14—14 of FIG. 11.
Figure 15:
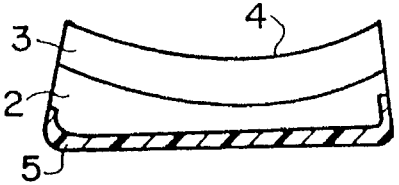
FIG. 15 is a transverse cross-section along lines 15—15 of FIG. 11.
Figure 13:
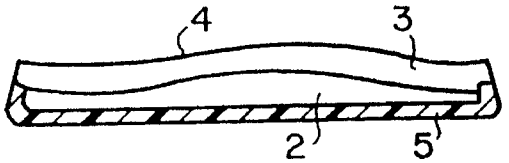
FIG. 13 is a transverse cross-section along lines 13—13 of FIG. 11.

Casual type shoes, such as those with leather uppers which are worn for street use, for walking and reasonably dressy occasions, have a top layer with a hardness of 25–35 and a density of 0.30–0.45. The lower layer of this type of shoe has a hardness of 55–70 and density of 0.75–0.95. An athletic shoe used for running or tennis has an upper layer hardness of 30–40 and a density of 0.4–0.6, while its lower layer has a hardness of 65–75 and a density of up to 1.1. Additionally, most basketball and running shoes would have a rubber outsole 5 on them for traction and slip resistance (FIG. 11).

Figures 6, 7, 8, 9, 10:
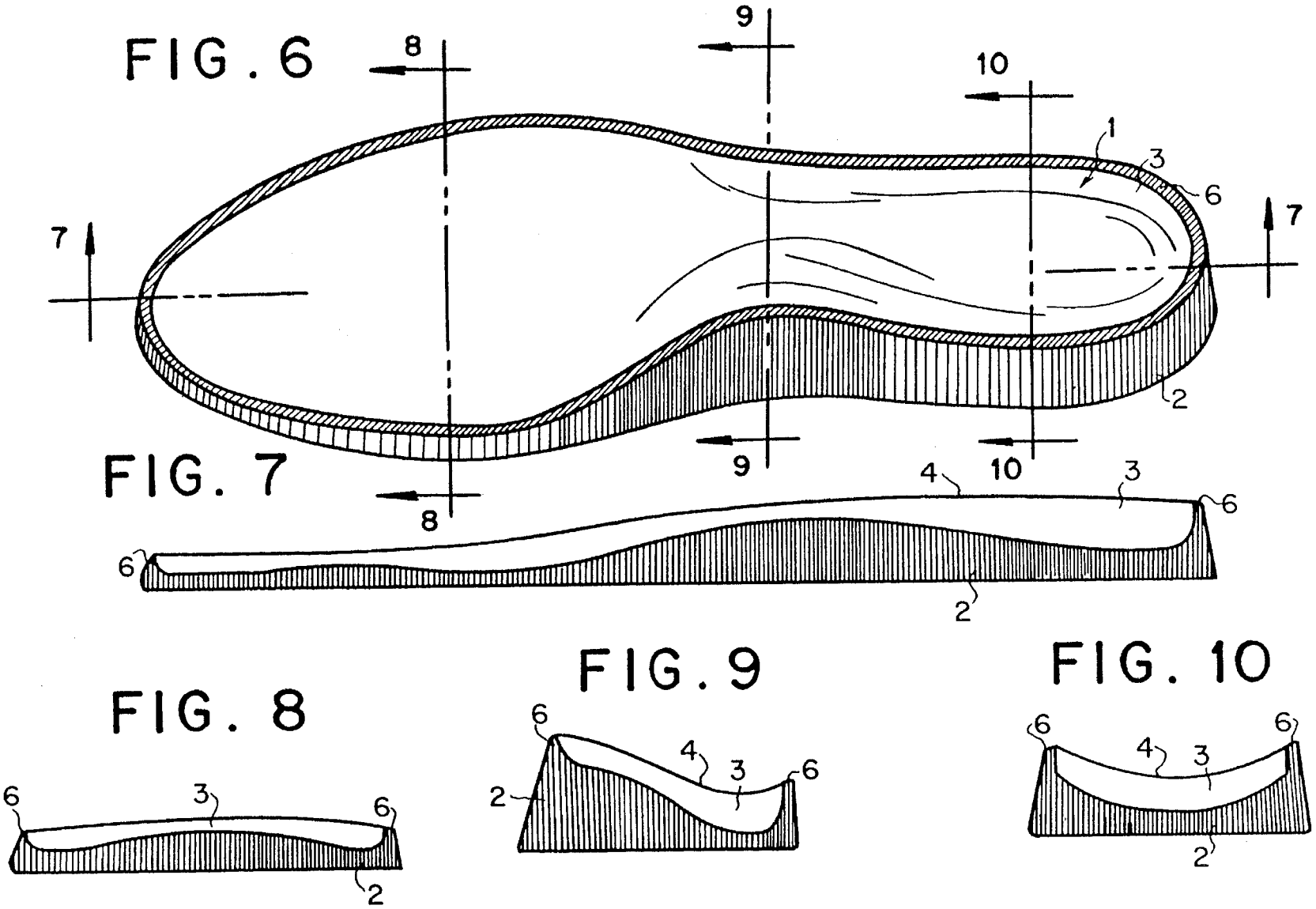
FIG. 6 is a perspective view of a second embodiment of the invention having a lateral support rim.
FIG. 7 is a longitudinal cross-section along lines 7—7 of FIG. 6.
FIG. 8 is a transverse cross-section along lines 8—8 of FIG. 7.
FIG. 9 is a transverse cross-section along lines 9—9 of FIG. 7.
FIG. 10 is a transverse cross-section along lines 10—10 of FIG. 7.

In order to prevent permanent deformation of the softer upper layer, the firmer lower layer may be provided with a cup shape as shown in FIGS. 6–10. The rim 6 rises to the same level as the uppermost surface 4 of the upper layer 3, thereby surrounding and supporting it. This prevents the softer layer from deforming sideways and thereby compressing too far and allowing early failure of the softer layer. This action is similar to the effect of the cup under the heel which was described above. By supporting the outer portion, the softer layer is maintained in the center of the shoe bottom to assist its shock absorbing function. The rim 6 may surround only a portion of the upper layer such as the heel (FIG. 10). However, it may also surround the entire outer edge of the upper layer (FIGS. 8–10).

FIGS. 11–15 show the shoe bottom of the present invention with a rubber outsole 5. The outsole may cover only the bottom of the lower layer or it may turn up the outside of the lower layer as shown in FIGS. 12–15. The rubber outsole 5 provides traction and abrasion resistance for the bottom of the shoe bottom. When outsole 5 is used the two densities of PU may be molded into the shell sole (outsole) otherwise the outsole may be glue or bonded to the layers.

Figures 16, 17, 18, 19, 20:
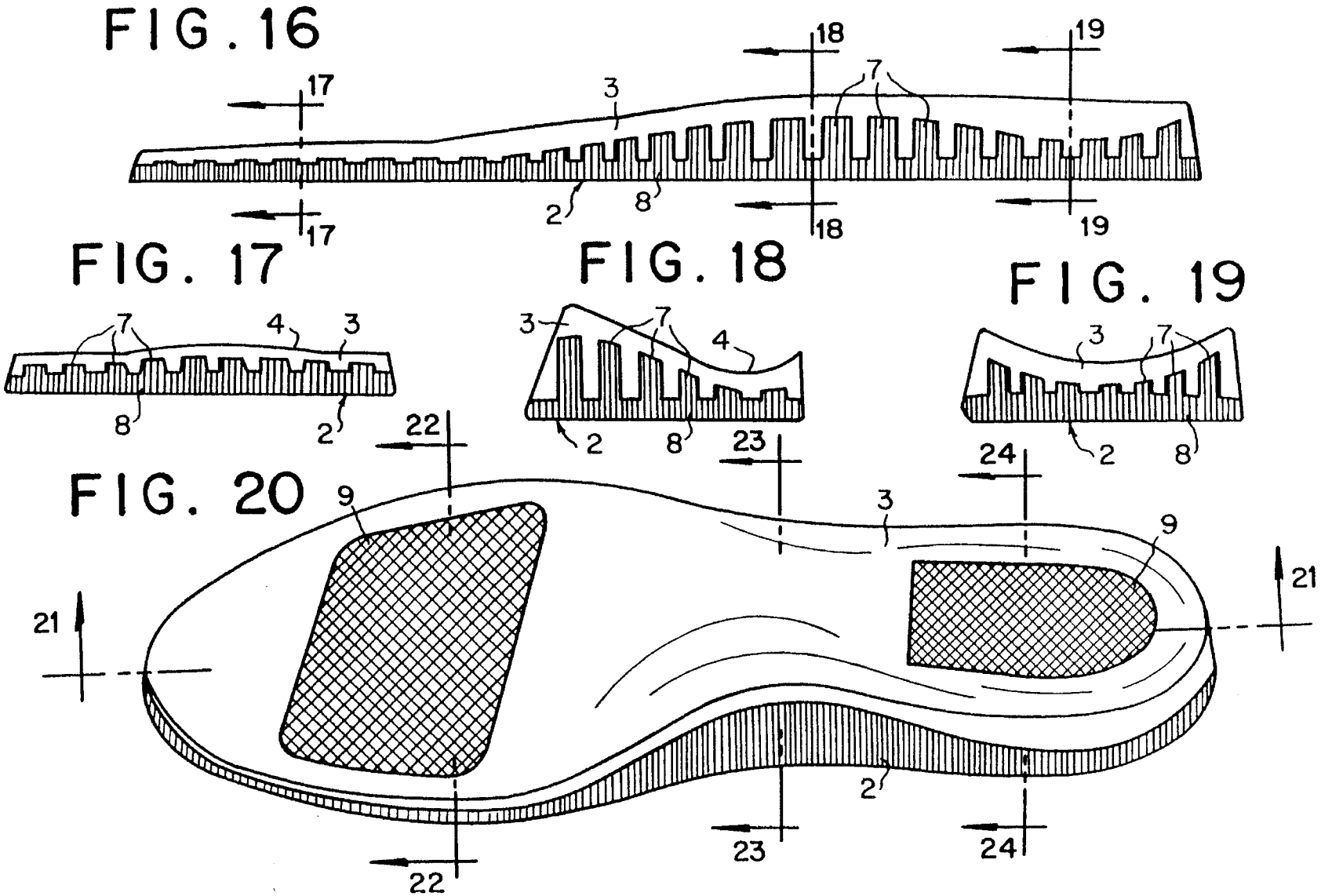
FIG. 16 is a longitudinal cross-sectional view of a third embodiment of the invention.
FIG. 17 is a transverse cross-sectional view of the embodiment shown in FIG. 16.
FIG. 18 is a transverse cross-section along lines 18—18 of FIG. 16.
FIG. 19 is a transverse cross-section along lines 19—19 of FIG. 16.
FIG. 20 is a perspective view of a fourth embodiment of the invention having shock absorbing inserts.
Figure 21:
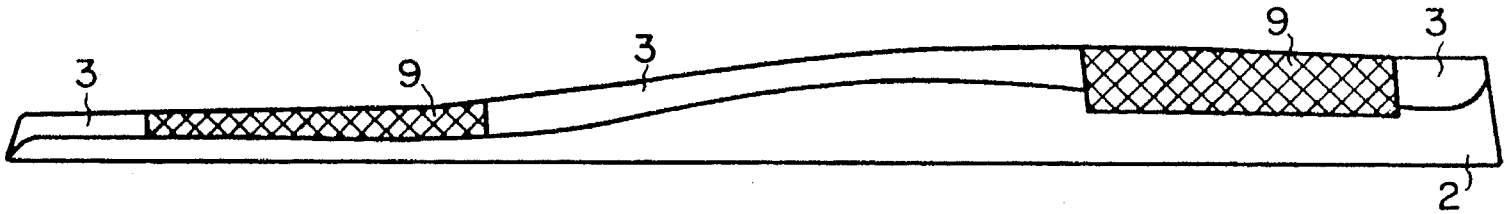
FIG. 21 is a longitudinal cross-sectional view of the embodiment of FIG. 20.
Figure 23:
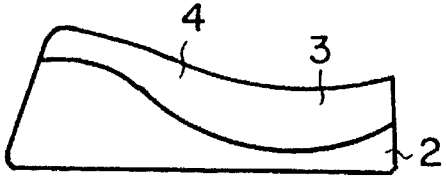
FIG. 23 is a transverse cross-section along lines 23—23 of FIG. 20.
Figure 24:
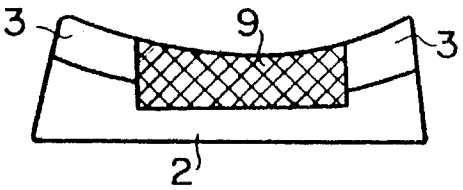
FIG. 24 is a transverse cross-section along lines 24—24 of FIG. 20.

A further embodiment (FIGS. 16–19) permits a fine tuning of the composite flexibility of the shoe bottom. Finger-like projections 7 are used to form the upper portion of lower layer 2. The projections extend upward from a base 8. The softer layer is injection molded over the projections allowing the softer material to flow into the interstices between the projections 7. This provides a softer shoe bottom as the projections 7 may each deform sideways when compressed downward. The bulging, distorting and deforming sideways provides more comfort at a slight reduction in support. The finger-like projection extends a greater height from base 8 at certain points to provide raised support. For example, FIG. 18 shows the longer projections beneath the arch area of the shoe bottom. FIG. 19 also shows longer projections to the outside of the heel portion to provide cupping for the heel as previously described.

Figure 22:
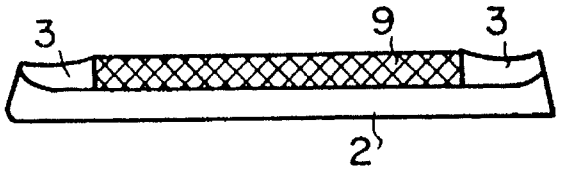
FIG. 22 is a transverse cross-section along lines 22—22 of FIG. 20.
Figure 25:
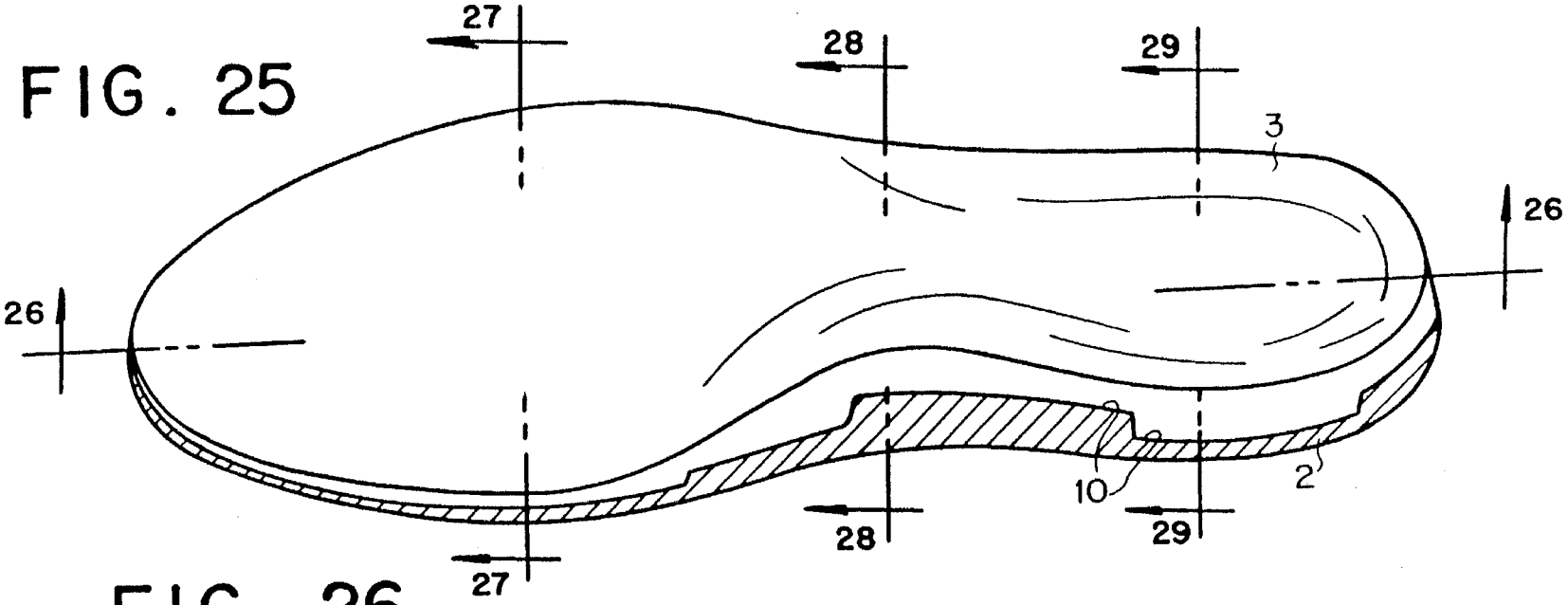
FIG. 25 is a perspective view of a sixth embodiment of the invention.
Figure 26:
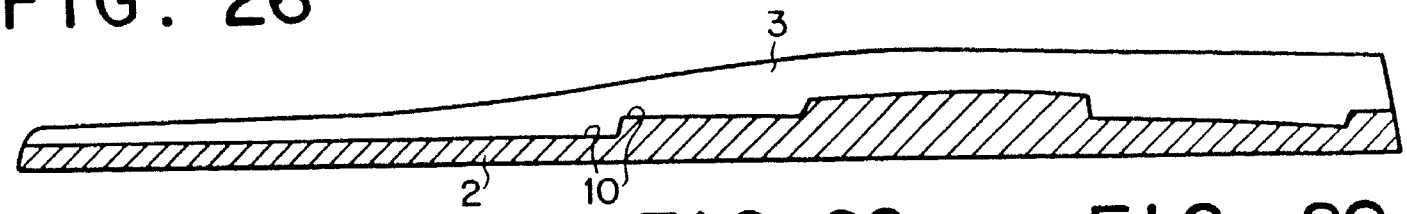
FIG. 26 is a longitudinal cross-section along lines 26—26 of FIG. 25.
Figure 29:
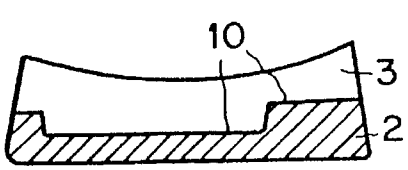
FIG. 29 is a transverse cross-section along lines 29—29 of FIG. 25.
Figure 28:
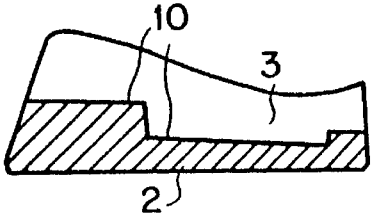
FIG. 28 is a transverse cross-section along lines 28—28 of FIG. 25.
Figure 27:
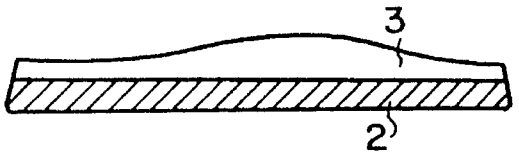
FIG. 27 is a transverse cross-section along lines 27—27 of FIG. 25.
Figure 30:
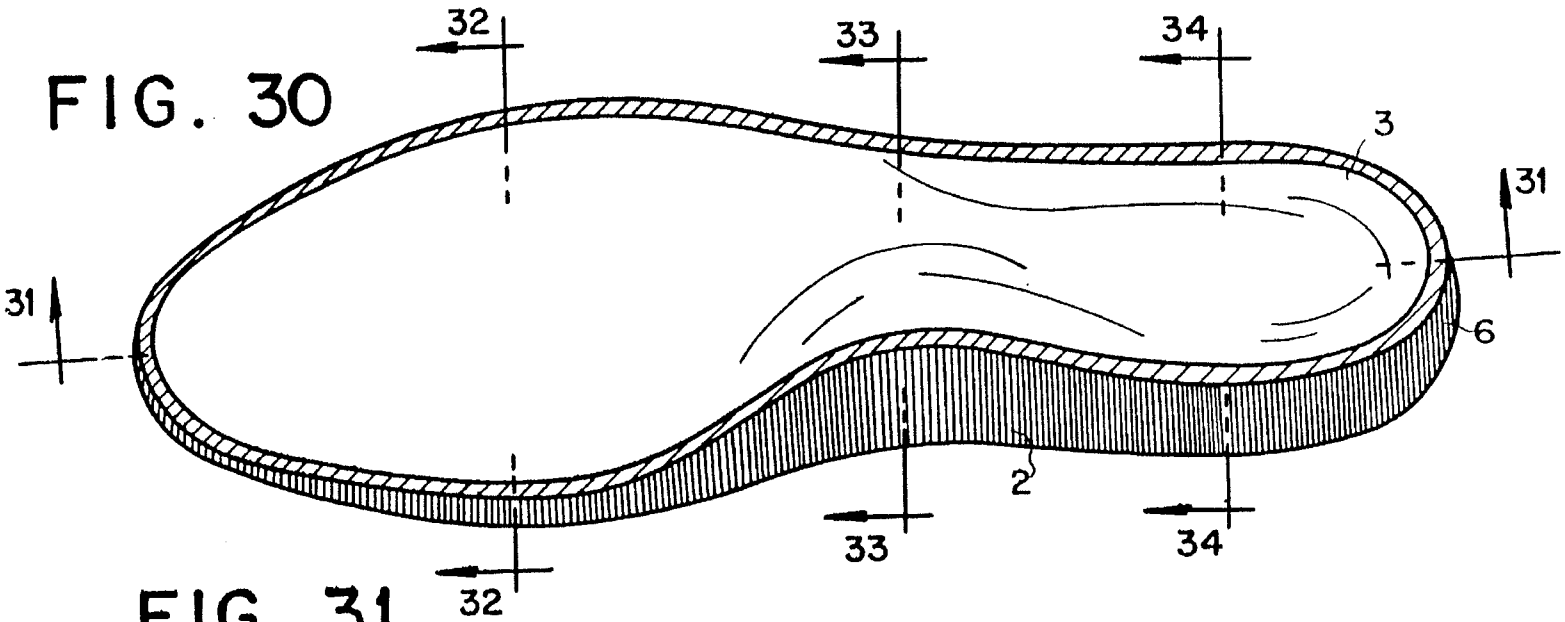
FIG. 30 is a perspective view of a modified sixth embodiment of the invention.
Figure 31:
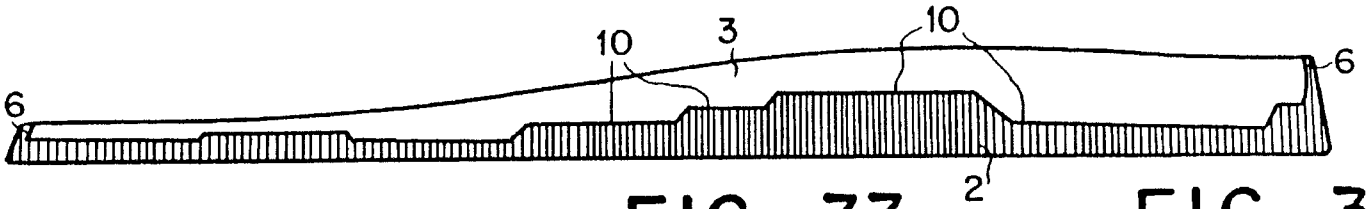
FIG. 31 is a longitudinal cross-section along lines 31—31 of FIG. 30.
Figure 33:
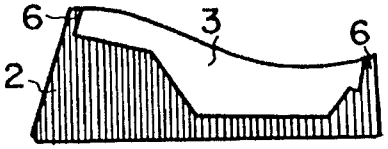
FIG. 33 is a transverse cross-section along lines 33—33 of FIG. 30.
Figure 34:
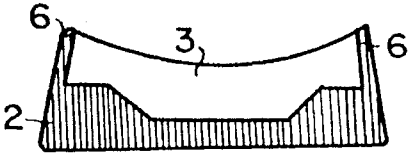
FIG. 34 is a transverse cross-section along lines 34—34 of FIG. 30.
Figure 32:
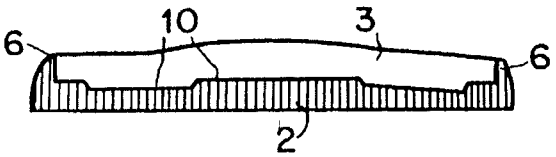
FIG. 32 is a transverse cross-section along lines 32—32 of FIG. 30.
Figure 36:
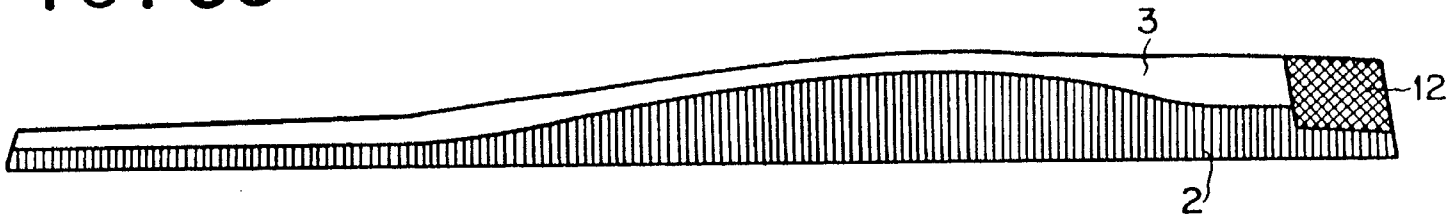
FIG. 36 is a longitudinal cross-section along lines 36—36 of FIG. 35.
Figure 35:
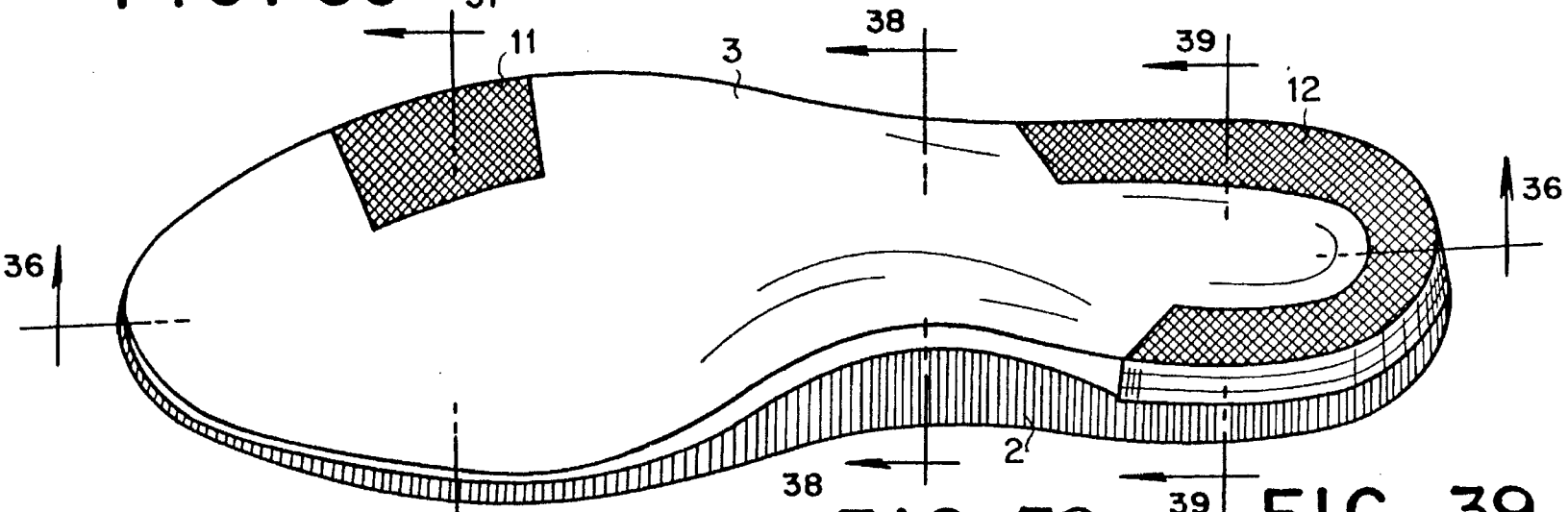
FIG. 35 is a perspective view of the shoe bottom of the invention having stabilizing inserts.
Figure 39:
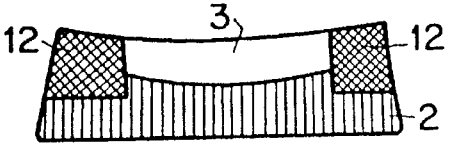
FIG. 39 is a transverse cross-section along lines 39—39 of FIG. 35.
Figure 38:
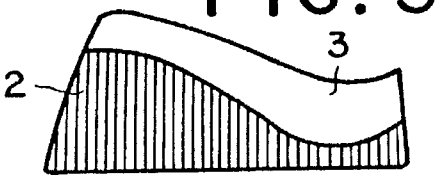
FIG. 38 is a transverse cross-section along lines 38—38 of FIG. 35.
Figure 37:
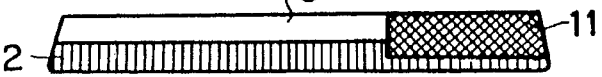
FIG. 37 is a transverse cross-section along lines 37—37 of FIG. 35.

FIG. 20 shows the shoe bottom of the present invention with the addition of shock foam inserts 9. The inserts 9 are positioned beneath the portions of the foot which take the large shock forces generated in activities such as running. As is seen in FIGS. 21–24, the shock foam inserts extend upward from the lower layer to provide additional cushioning for the foot. The inserts may extend slightly into the lower layer (FIG. 24) or may extend from its upper surface (FIG. 22). These inserts 9 may be molded in as a third density of PU rather than separate shock foam pieces.

FIGS. 25–29 show a further embodiment of the shoe bottom. The firmer material is formed with a stepped surface rather than the gently curved surface of FIGS. 1–5. The firmer layer need not be shaped to smooth perfection. In the embodiment of FIGS. 25–29, the softer upper layer will smooth out imperfections in the lower, firmer layer even though step changes 10 In thickness of the lower layer are used.

FIGS. 30–34 show the embodiment of FIGS. 25–29 with the addition of a rim 6. As described above, rim 6 provides additional lateral support to the upper layer while preventing permanent deformation of the upper layer.

FIGS. 35–44 show the shoe bottom with the addition of stability inserts 11 and 12. The stability inserts are positioned to create a portion of much greater support. The stability inserts are preformed and then positioned in the mold prior to injection molding the shoe bottom. The inserts are positioned to provide greater support to discrete portions of the foot, for example, the u-shaped insert which is placed around the perimeter of the heel provides greater support on the outside of the heel, forcing the body's fatty tissues inward to provide natural cushioning to the central part of the heel as was described above.

Figure 40:
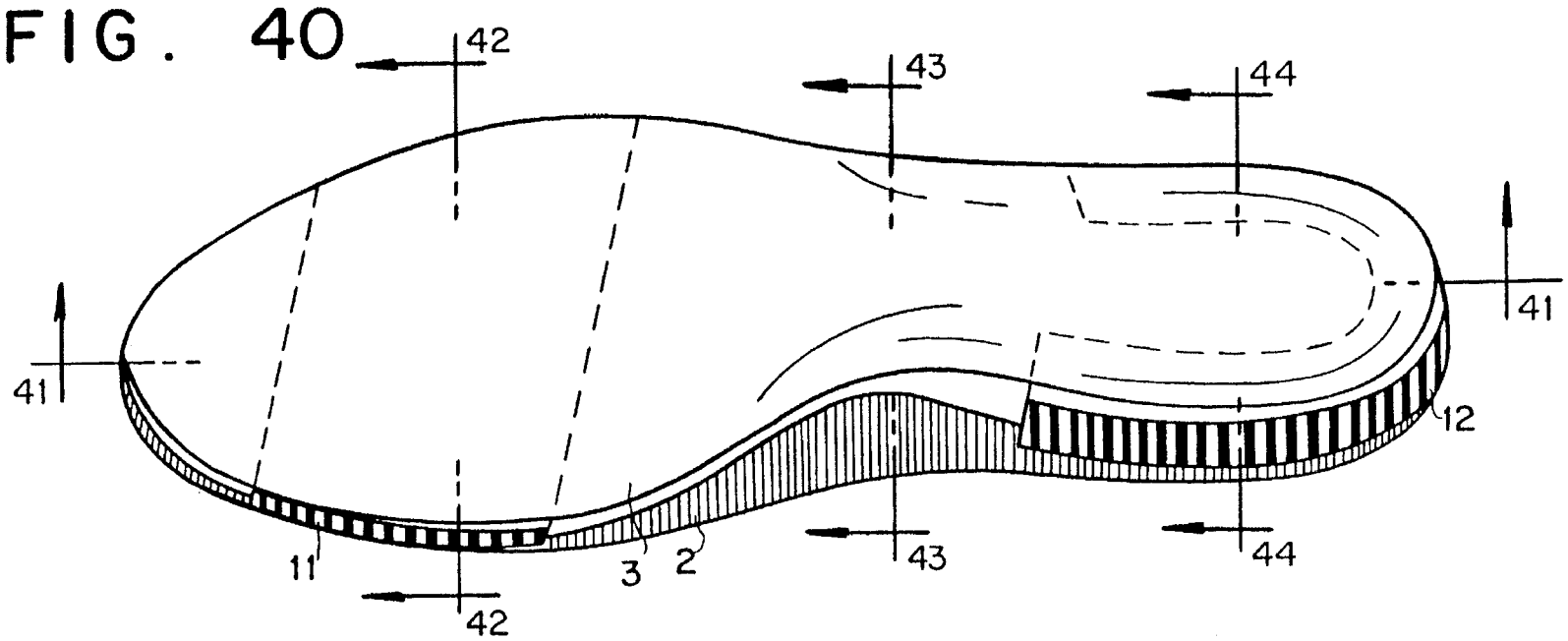
FIG. 40 is a modified version of the shoe bottom of FIG. 35 wherein the upper layer extends over the stabilizing inserts.
Figure 41:
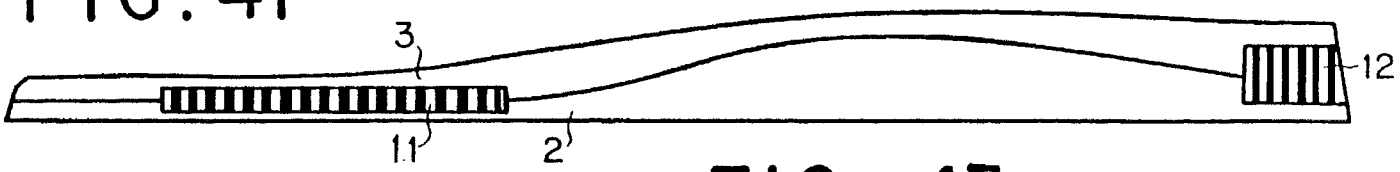
FIG. 41 is a longitudinal cross-section along lines 41—41 of FIG. 40.
Figure 43:
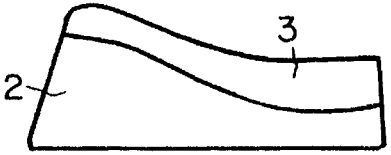
FIG. 43 is a transverse cross-section along lines 43—43 of FIG. 40.
Figure 44:
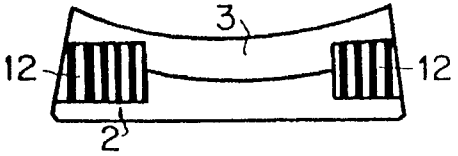
FIG. 44 is a transverse cross-section along lines 44—44 of FIG. 40.
Figure 42:
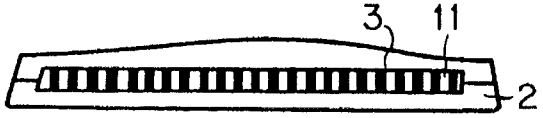
FIG. 42 is a transverse cross-section along lines 42—42 of FIG. 40.

In order to provide a more continuous upper surface and provide padding between the stabilizing inserts and the foot, the upper layer may extend over the stabilizing inserts (FIGS. 40–44). As is seen in FIG. 40, a heel insert 12 extends upward from the lower layer to provide additional support at the outer marginal portions of the heel (FIG. 44). This insert is covered by a portion of upper layer 3 to pad the insert slightly without substantially diminishing the support provided by the insert to the heel. Similarly, insert 11 of FIG. 42 provides support to the ball of the foot and is padded by upper layer 3.

Figure 45:
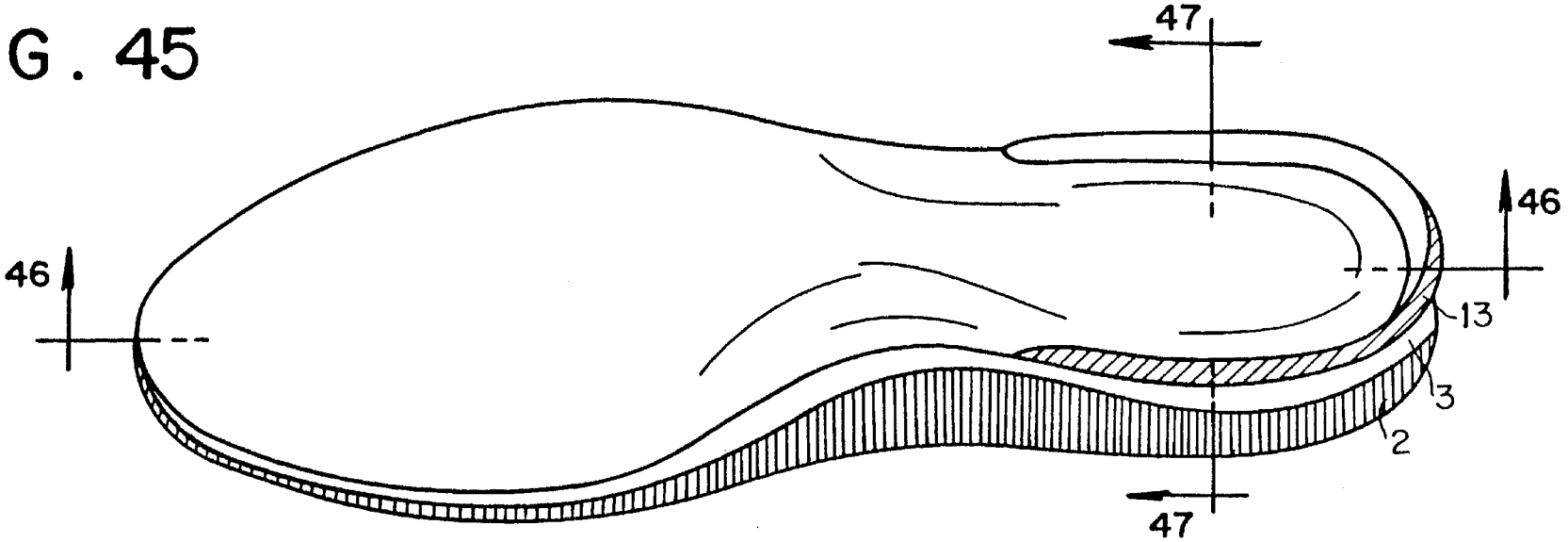
FIG. 45 is a perspective view of the shoe bottom of the invention having an extending heel cup.
Figure 46:
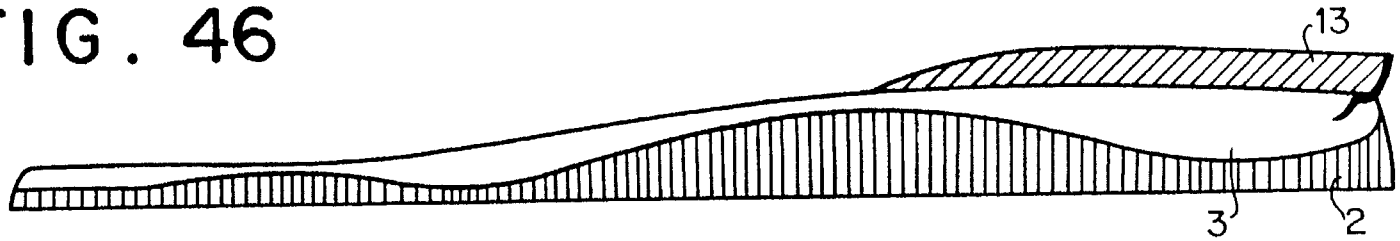
FIG. 46 is a longitudinal cross-section along lines 46—46 of FIG. 45.
Figure 47:
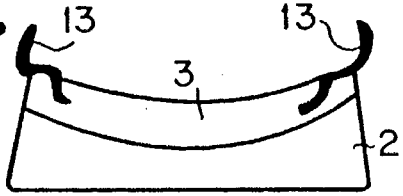
FIG. 47 is a transverse cross-section along lines 47—47 of FIG. 45.
Figure 48:
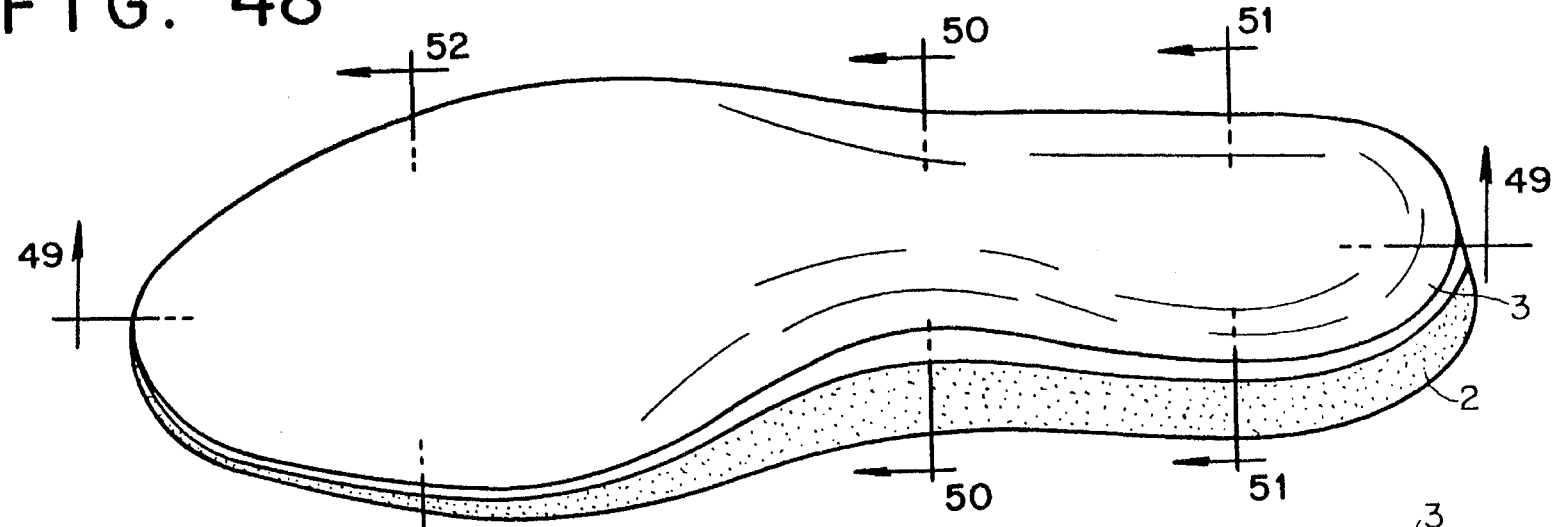
FIG. 48 is a perspective view of the shoe bottom of the invention having a stepped outer periphery.
Figure 49:
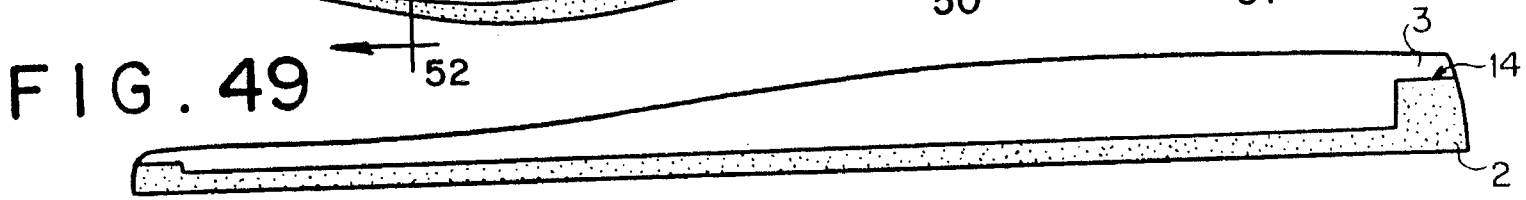
FIG. 49 is a longitudinal cross-section along lines 49—49 of FIG. 48.
Figure 51:
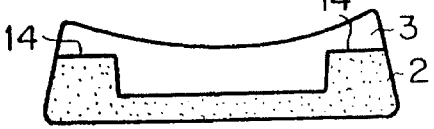
FIG. 51 is a transverse cross-section along lines 51—51 of FIG. 48.
Figure 50:
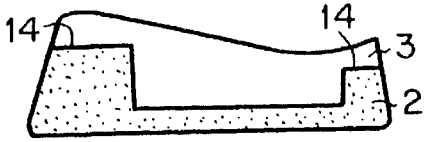
FIG. 50 is a transverse cross-section along lines 50—50 of FIG. 48.
Figure 52:
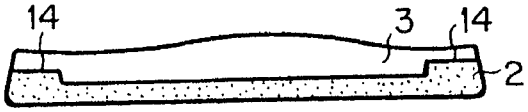
FIG. 52 is a transverse cross-section along lines 52—52 of FIG. 48.
Figure 53:
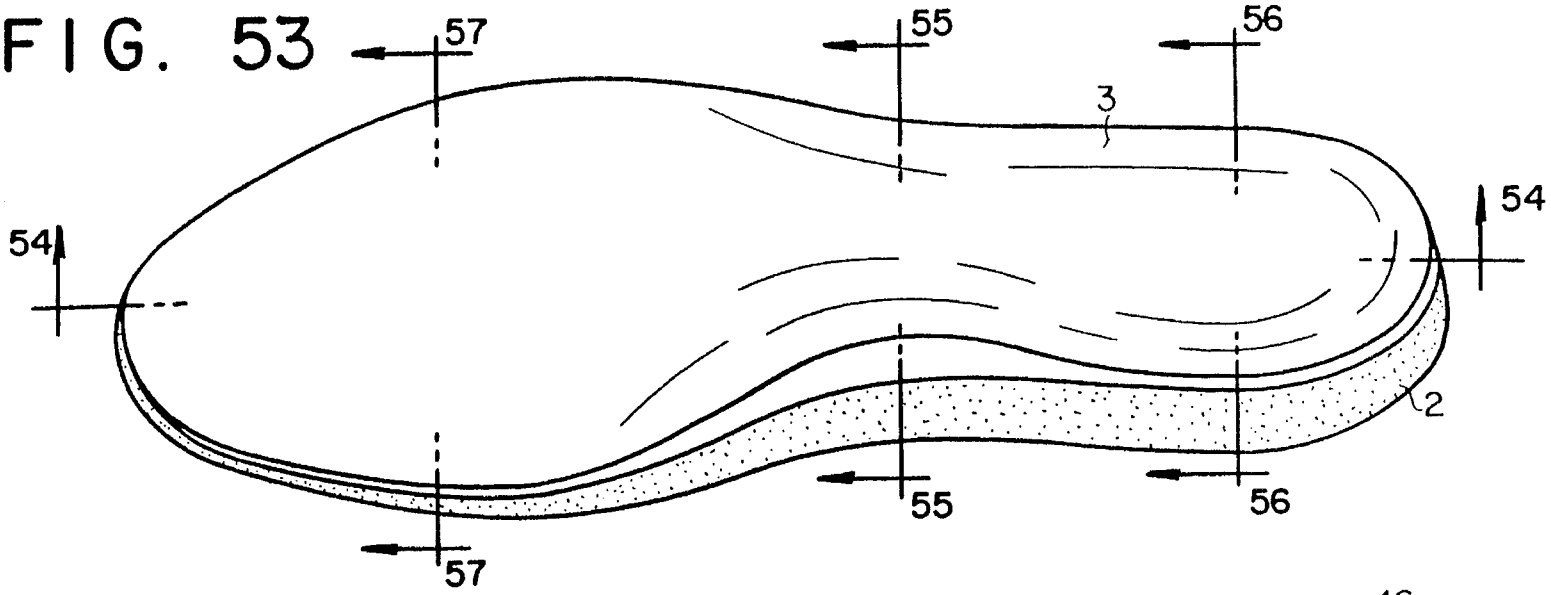
FIG. 53 is a perspective view of a modified version of the shoe bottom of FIG. 48.
Figure 54:
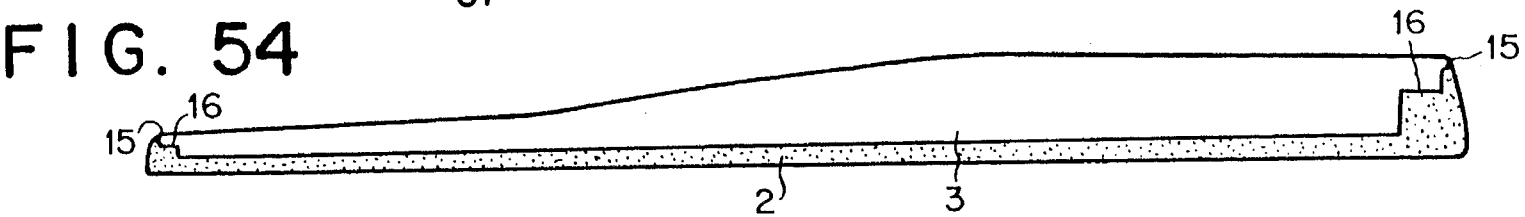
FIG. 54 is a longitudinal cross-section along lines 54—54 of FIG. 53.
Figure 56:
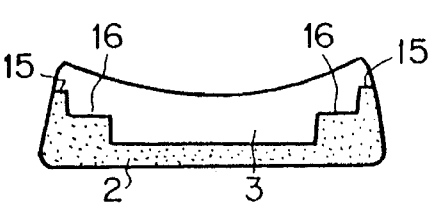
FIG. 56 is a transverse cross-section along lines 56—56 of FIG. 53.
Figure 55:
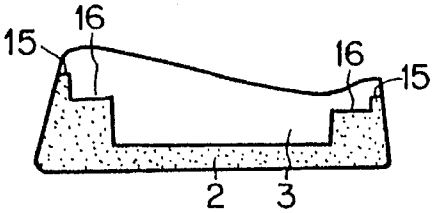
FIG. 55 is a transverse cross-section along lines 55—55 of FIG. 53.
Figure 57:
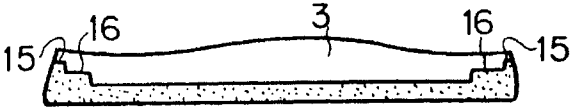
FIG. 57 is a transverse cross-section along lines 57—57 of FIG. 53.
Figure 58:
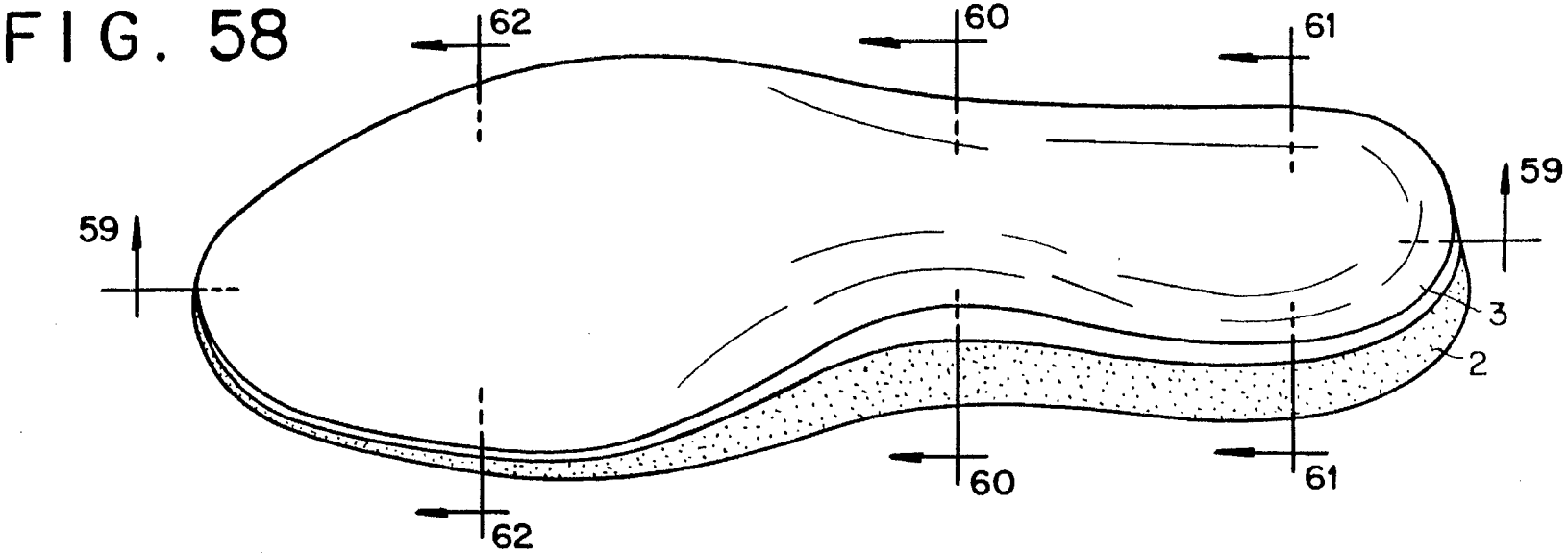
FIG. 58 is a perspective view of the shoe bottom of the invention having a rounded peripheral projection.
Figure 59:
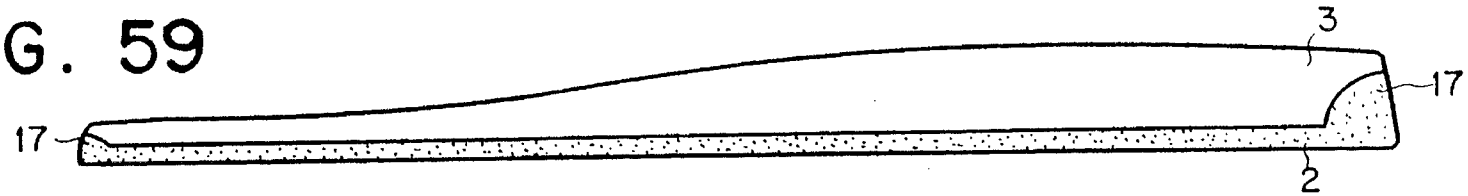
FIG. 59 is a longitudinal cross-section along lines 59—59 of FIG. 58.
Figure 61:
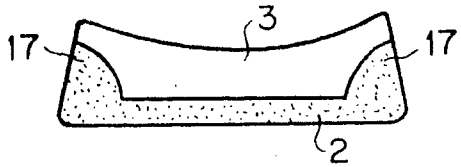
FIG. 61 is a transverse cross-section along lines 61—61 of FIG. 58.
Figure 60:
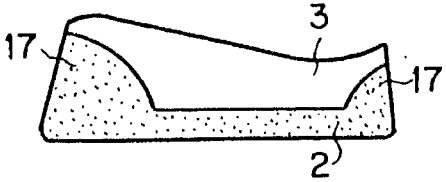
FIG. 60 is a transverse cross-section along lines 60—60 of FIG. 58.
Figure 62:
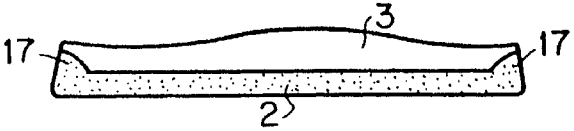
FIG. 62 is a transverse cross-section along lines 62—62 of FIG. 58.
Figure 63:
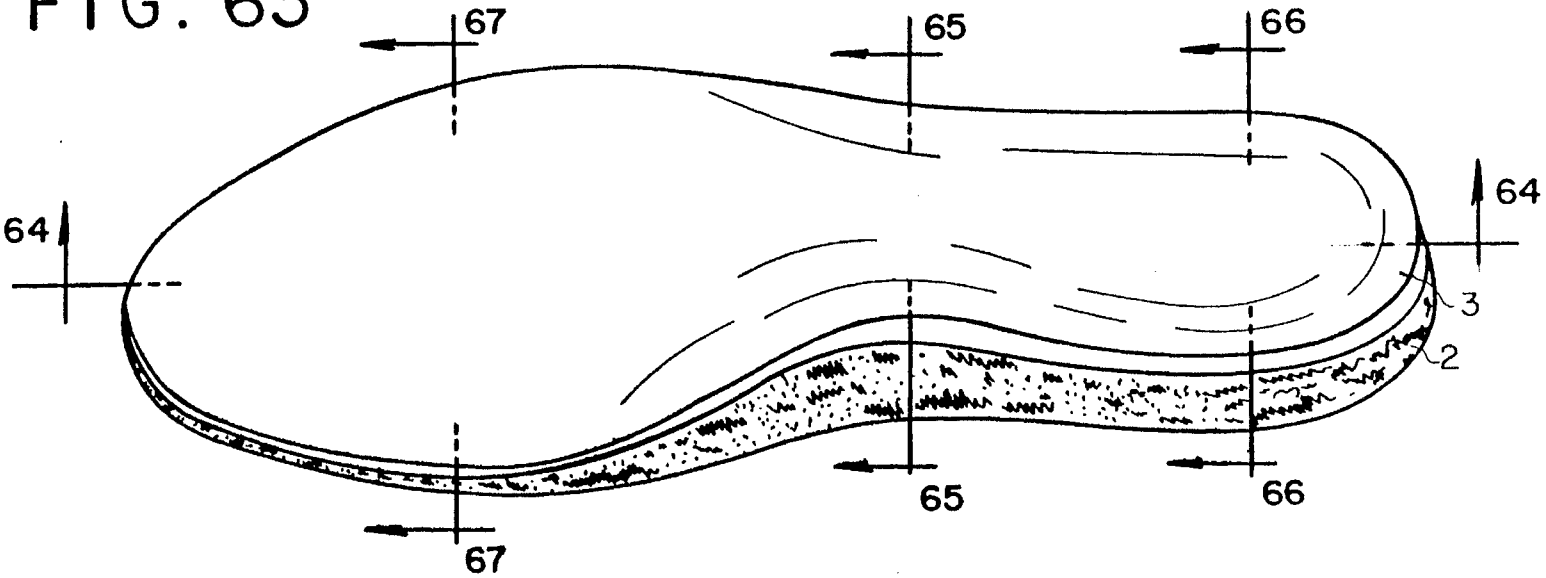
FIG. 63 is a perspective view of the shoe bottom of the invention having a sloped periphery.
Figure 64:
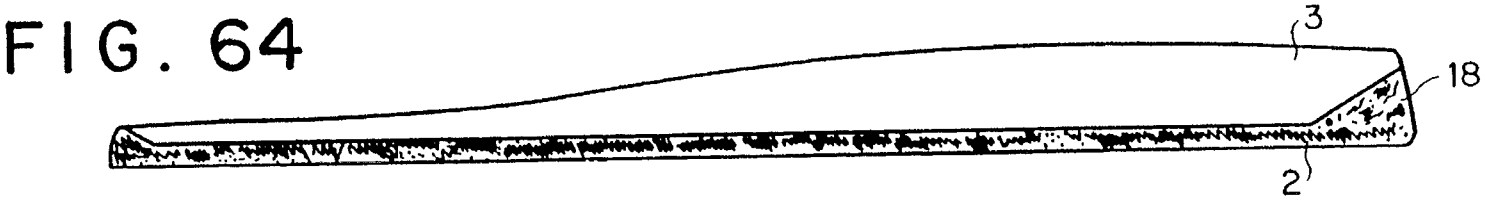
FIG. 64 is a longitudinal cross-section along lines 64—64 of FIG. 63.
Figure 66:
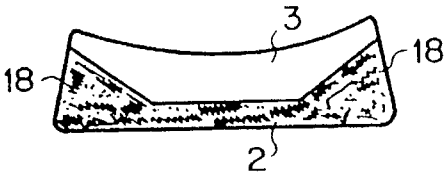
FIG. 66 is a transverse cross-section along lines 66—66 of FIG. 63.
Figure 65:
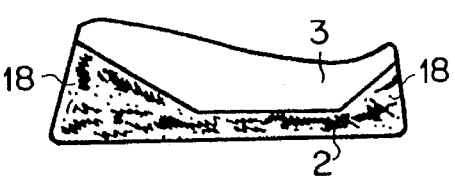
FIG. 65 is a transverse cross-section along lines 65—65 of FIG. 63.
Figure 67:
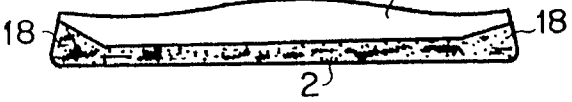
FIG. 67 is a transverse cross-section along lines 67—67 of FIG. 63.
Figure 68:
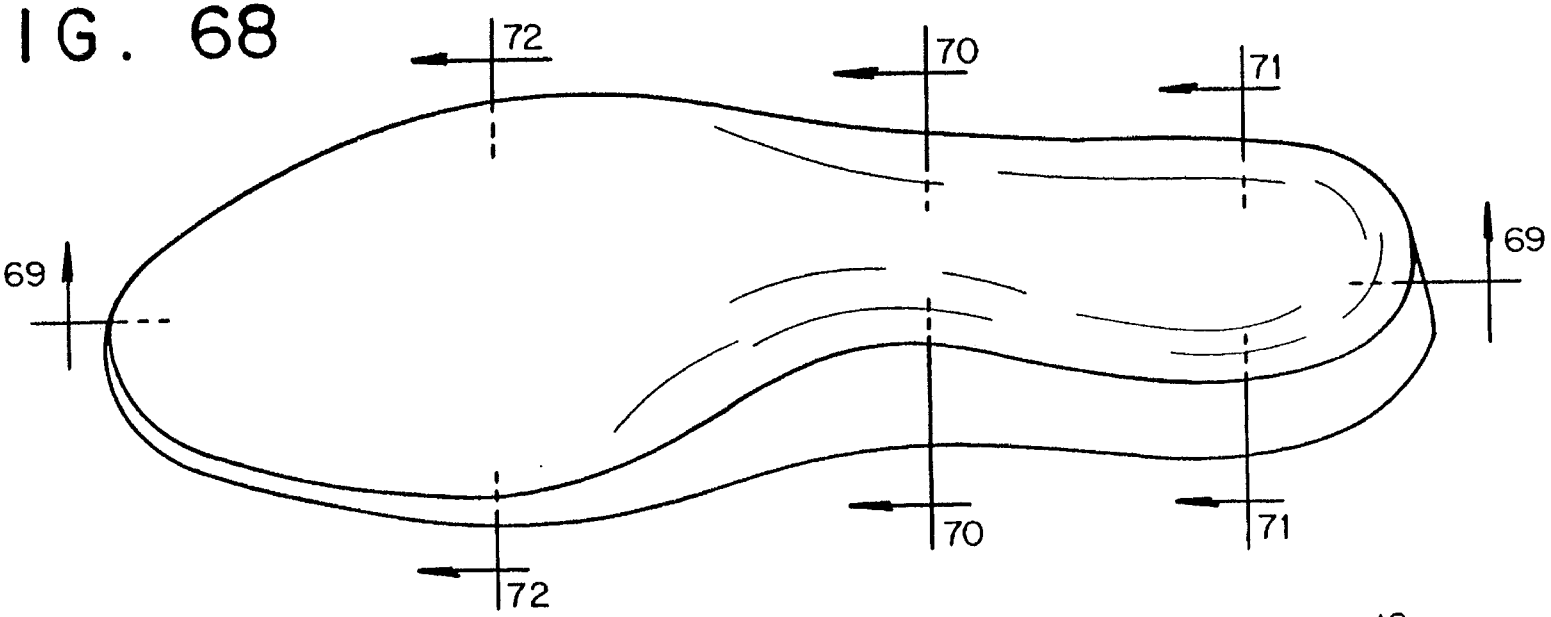
FIG. 68 is a perspective view of the shoe bottom of the invention on having an encased stabilizer.
Figure 69:
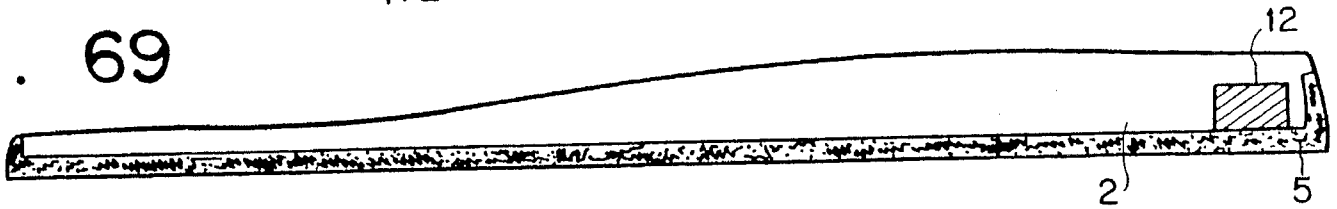
FIG. 69 is a longitudinal cross-section along lines 69—69 of FIG. 68.
Figure 71:
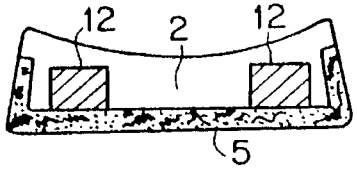
FIG. 71 is a transverse cross-section along lines 71—71 of FIG. 68.
Figure 70:
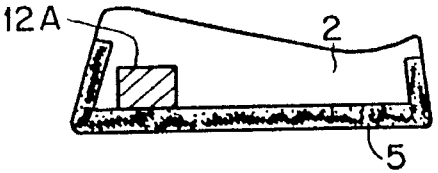
FIG. 70 is a transverse cross-section along lines 70—70 of FIG. 68.
Figure 72:
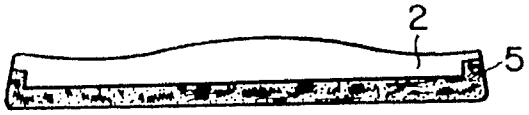
FIG. 72 is a transverse cross-section along lines 72—72 of FIG. 68.
Figure 73:
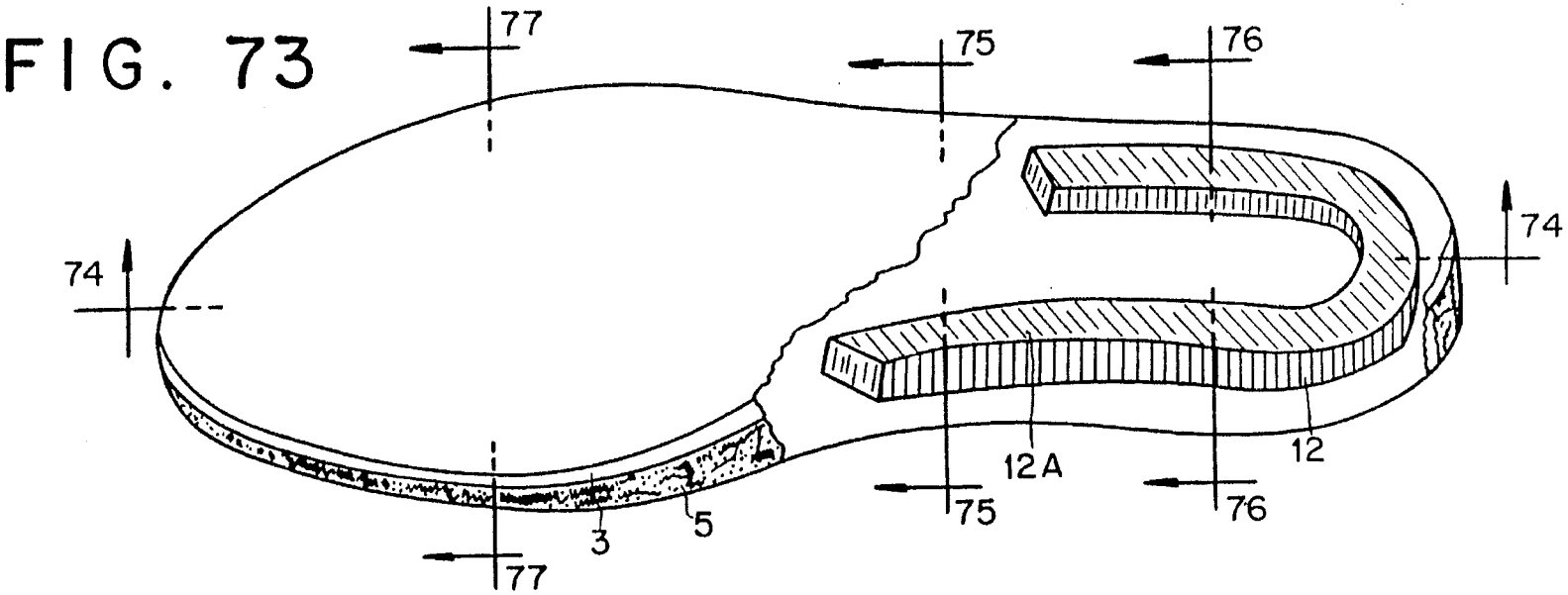
FIG. 73 is a partially broken away perspective view of a modified embodiment of the shoe bottom of FIG. 68.
Figure 74:
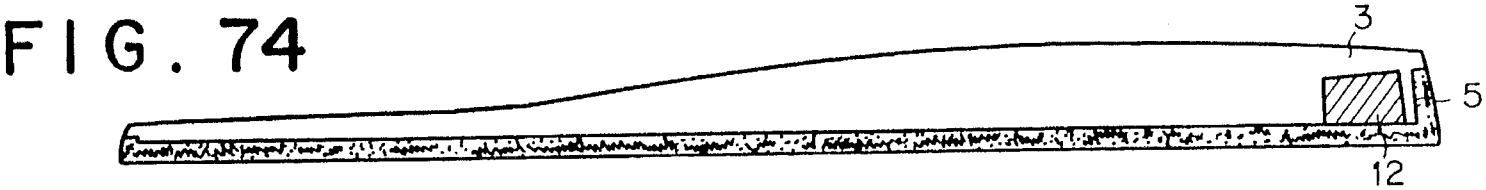
FIG. 74 is a longitudinal cross-section along lines 74—74 of FIG. 73.
Figure 76:
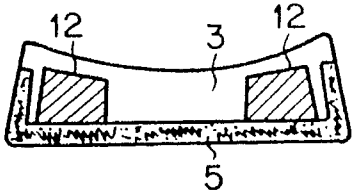
FIG. 76 is a transverse cross-section along lines 76—76 of FIG. 73.
Figure 75:
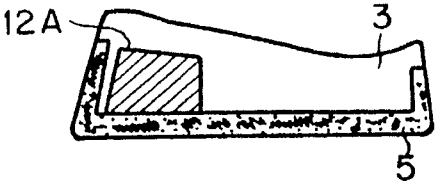
FIG. 75 is a transverse cross-section along lines 75—75 of FIG. 73.
Figure 77:
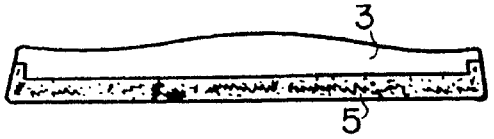
FIG. 77 is a transverse cross-section along lines 77—77.
Figure 78:
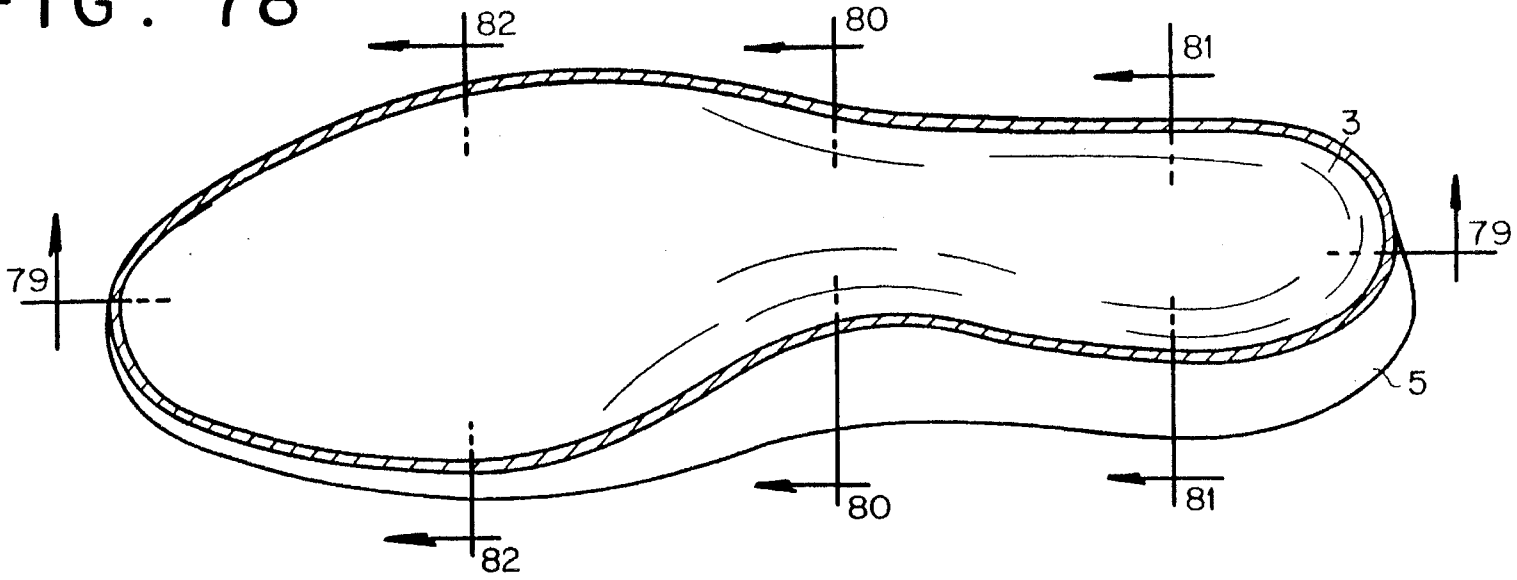
FIG. 78 is a perspective view of a shoe bottom of the invention with an outsole which covers the sides of the shoe bottom.
Figure 79:
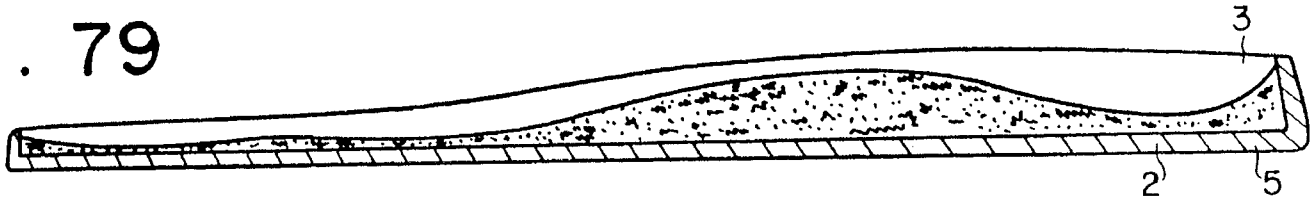
FIG. 79 is a longitudinal cross-section along lines 79—79 of FIG. 78.
Figure 80:
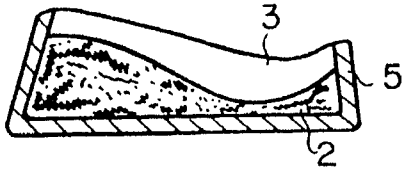
FIG. 80 is a transverse cross-section along lines 80—80 of FIG. 78.
Figure 81:
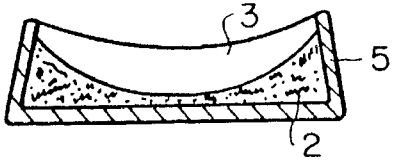
FIG. 81 is a transverse cross-section along lines 81—81 of FIG. 78.
Figure 82:
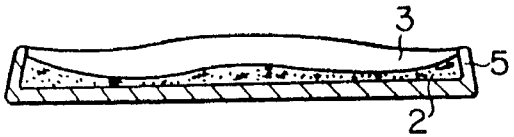
FIG. 82 is a transverse cross-section along lines 82—82 of FIG. 78.
Figure 83:
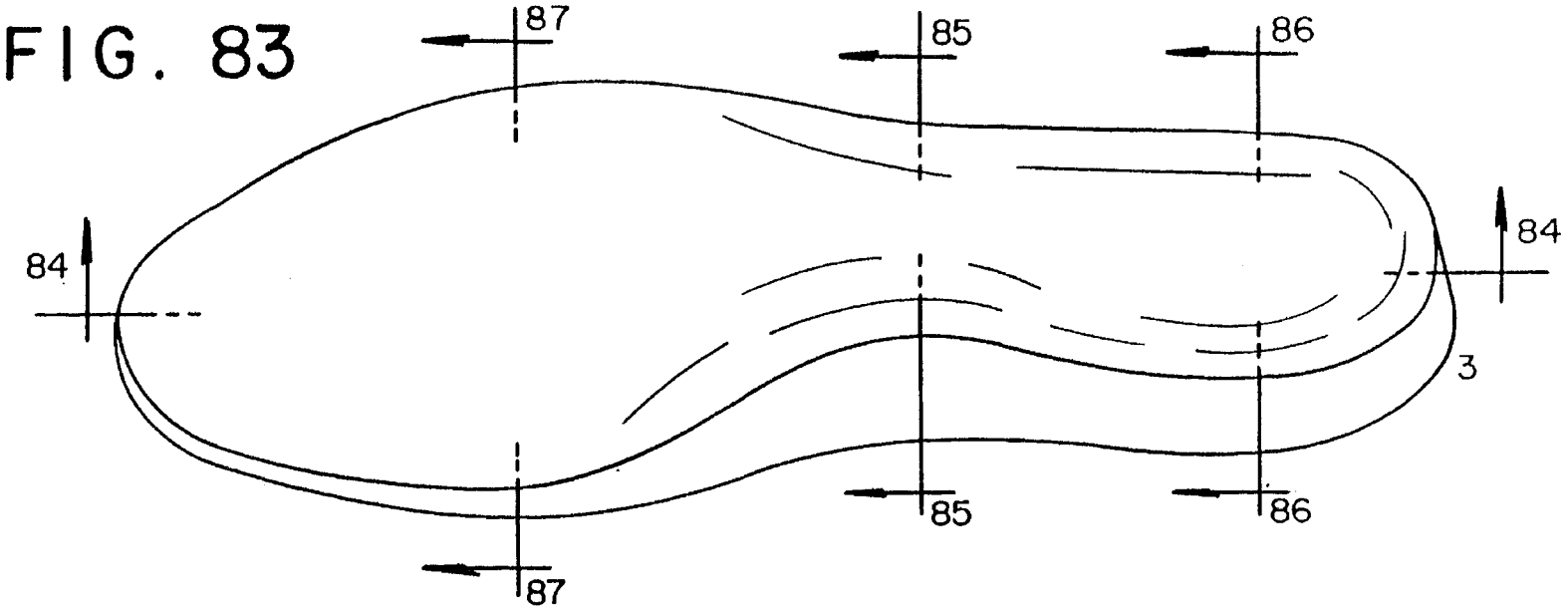
FIG. 83 is a perspective view of the shoe bottom of the invention having a first internal comfort stabilizer.
Figure 84:
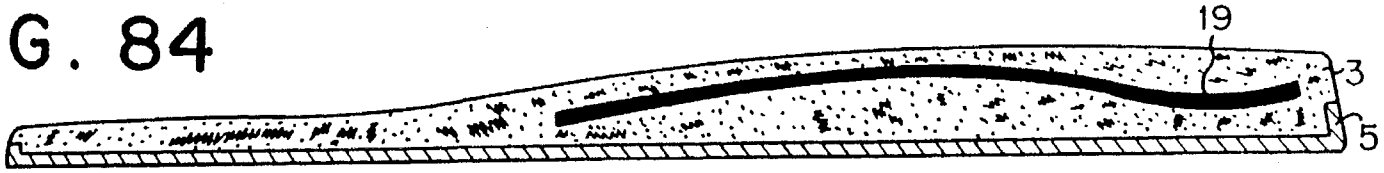
FIG. 84 is a longitudinal cross-section along lines 84—84 of FIG. 83.
Figure 86:
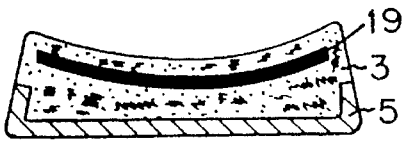
FIG. 86 is a transverse cross-section along lines 86—86 of FIG. 83.
Figure 85:
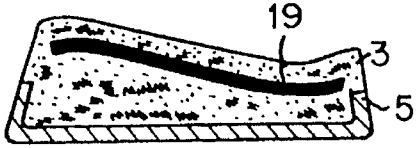
FIG. 85 is a transverse cross-section along lines 85—85 of FIG. 83.
Figure 87:
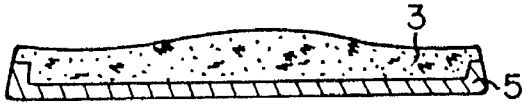
FIG. 87 is a transverse cross-section along lines 87—87 of FIG. 83.
Figure 88:
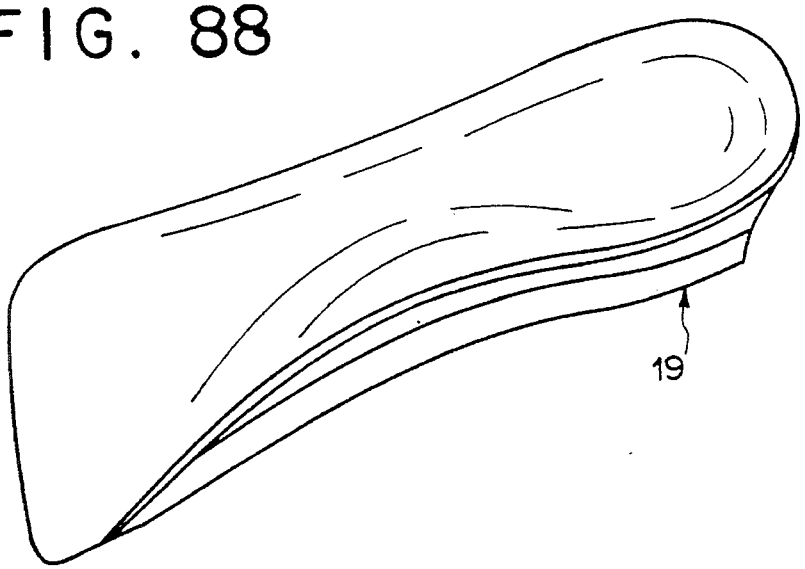
FIG. 88 is a perspective view of a second embodiment of the internal comfort stabilizer of the invention.
Figure 89:
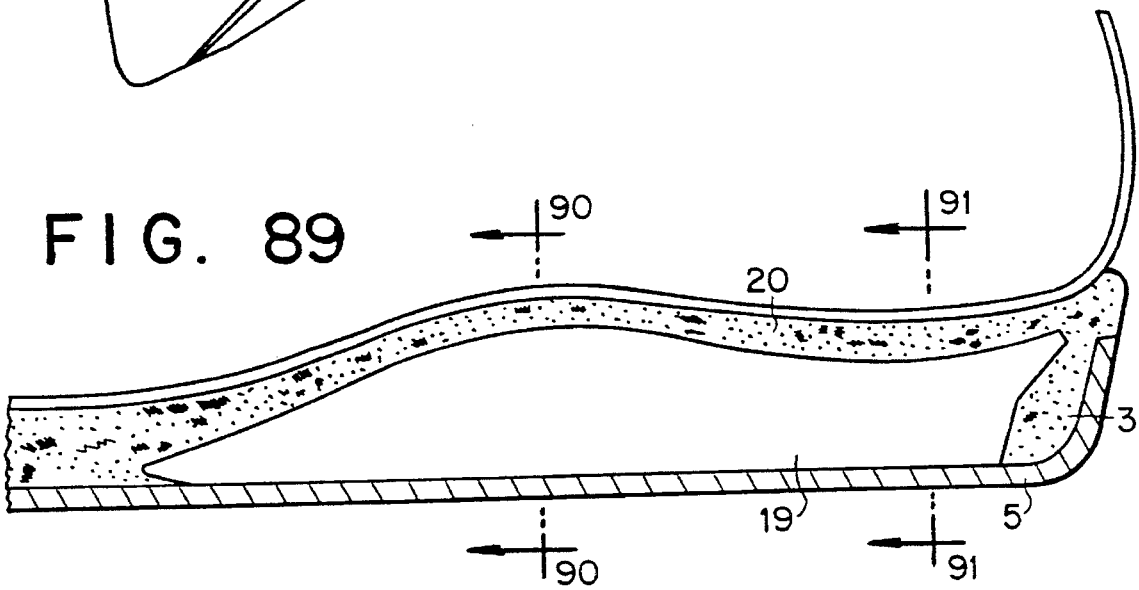
FIG. 89 is a longitudinal cross-section of a shoe bottom incorporating the stabilizer of FIG. 88.
Figure 90:
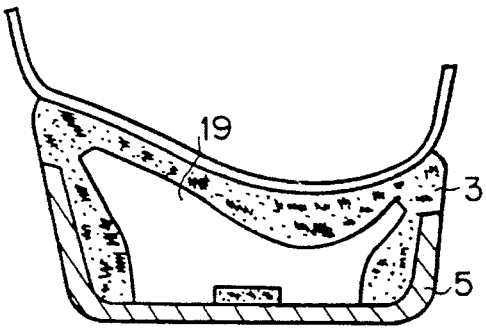
FIG. 90 is a transverse cross-section along lines 90—90 of FIG. 89.
Figure 91:
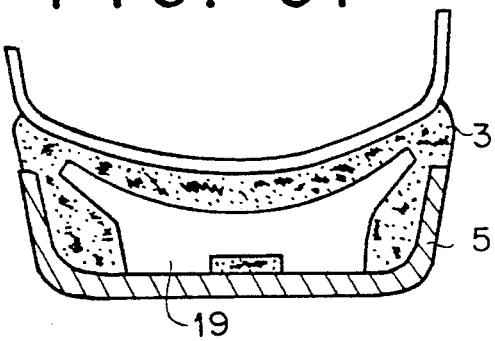
FIG. 91 is a transverse cross-section along lines 91—91 of FIG. 89.
Figure 92A:
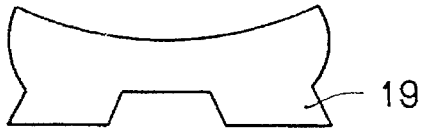
FIG. 92(*a–h*) shows cross-sectional views through the heel portion of various embodiments of the internal comfort stabilizer of the invention.
Figure 92B:
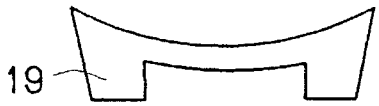
Figure 92C:
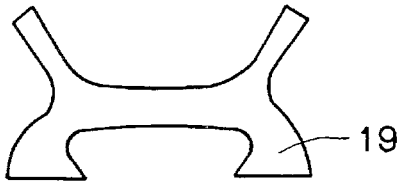
Figure 92D:
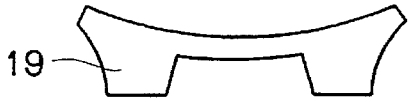
Figure 92E:
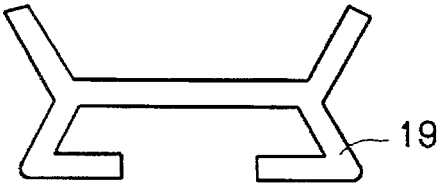
Figure 92F:
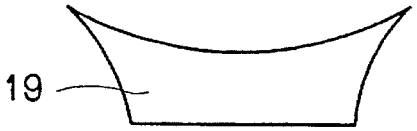
Figure 92G:
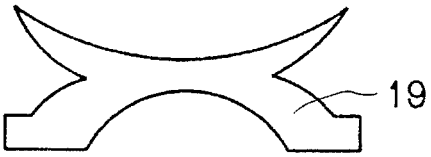
Figure 92H:
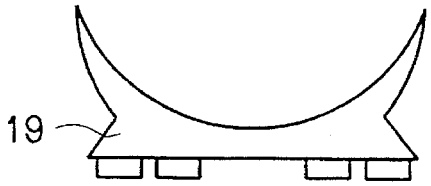

Additional support may be provided by a heel cup wall 13, as shown in FIGS. 45–47. The heel cup wall 13 extends upward and slightly outward from the uppermost surface 4 in the heel portion of the shoe bottom. This increases the lateral support provided the heel.

FIGS. 48–67 show alternate embodiments of the present invention. As is seen in FIGS. 48–52 the contour of the lower layer may be provided by a single step 14 change in height about the perimeter. Beneath the arch the step is higher than around the toe portion of the shoe bottom.

A further variation is shown in FIGS. 53–57 wherein the bottom has two steps 15, 16 which soften the change in support which is provided in the shoe bottom of FIG. 48–52. A more subtle change in support is provided while still functioning to push the fatty tissue at the heel of a wearer's foot beneath the heel to provide cushioning.

To provide a smooth variation in stabilizing support the shoe bottom may be made in the form shown in FIGS. 58–62. In this embodiment a rounded step 17 is provided. This rounded step 17 performs the function of step 14 while permitting a variation in the support which changes gradually.

For an even more gradual change in stabilizing support of the shoe bottom of FIGS. 63–67 may be used. This shoe bottom has a thicker perimeter 18 which slopes gently inward toward the shoe bottom's center.

FIGS. 68–72 show a further use of stability inserts 12. In the depicted shoe bottom a dress shoe look is provided by positioning the horseshoe shaped insert 12 within the shoe bottom. This provides a uniform outward appearance to the shoe bottom. However, it is easily seen that one leg 12A of the insert extends beneath the arch to provide arch support. The insert may have an upper surface which slopes inward sightly (FIG. 73–77) to create a cup-type support to more comfortably force the foot's fatty tissue inward to provide a natural cushion for the foot.

The outsole 5 may be used as a shell sole. That is two layers of shoe bottom may be injection molded within outsole 5. This produces the shoe bottom of FIGS. 78–82. The outsole is molded within the molding apparatus, the upper mold piece or last is then changed to a last having the contour fore the upper surface of the lower layer. The lower layer is then injection molded within outsole 5. The last is again changed and a last having the contour of the upper surface of the upper layer is used. The upper layer is then injection molded; the heat of the molding process attaches the three layers to one another. The upper may be captured by the shoe bottom during the molding process to attach it to the shoe bottom.

FIGS. 83–99 show the internal comfort stabilizer of the invention. The internal comfort stabilizer is made of a wire mesh-like material which permits the soft PU to flow through IT, or of solid material such as structural foam, molded plastic, firm foam, high-density foam or the like. The shoe bottoms are fabricated by insertion molding of the stabilizer within the shoe bottom. This permits a single density PU or PVC to be used with the stabilizer. The stabilizer may also be used in shoe bottoms made of additonal layers of different density PU.

As shown in FIG. 83–87 the basic internal comfort stabilizer 19 starts at the back of the heel and extends to just short of the ball of the foot. This stiffens the rear of the shoe bottom but permits it to flex at the ball of the foot. In this manner comfort stabilizer 19 supports the entire bottom of the foot from the heel to the ball of the foot. At the same time it facilitates flexing at the correct position. The rear part of the stabilizer piece may be tapered slightly to permit more soft material at the back of the heel to cushion during heel strike. The stabilizer is positioned low in the shoe bottom to permit a cushioning layer of material between the stabilizer and the foot.

In a dual density shoe bottom the first shot of material usually molds the lower firm layer. The comfort stabilizer can be molded in place at the same time. In this manner the stabilizer is captured by the lower layer and held in place by that layer while the second layer is molded. Alternatively, the comfort stabilizer may be inserted in the mold by hand prior to molding the second layer. However, it is preferred to have the stabilizer molded to the lower layer to prevent its movement while the second layer is molded. To further facilitate its attachment the comfort stabilizer may have holes in it to assist proper and complete flowing of the softer PU forming the upper layer.

Referring to FIGS. 83–87 there is shown a first embodiment of the comfort stabilizer 19 which provides stability and suppport with cushioning. The stabilizer is made of a fiberglass-like material. It is attached to the upper by foam pieces during the molding process. Alternatively, the stabilizer 19 may be held in place by protrusions 22 extending upward from the upper surface of the lower layer of firmer material. This positions the stabilizer with either a flat or contoured upper surface, in positions within the softer layer.

FIGS. 88–91 show a different embodiment of the internal comfort stabilizer 19. The stabilizer is shown in a dual density shoe bottom. The stabilizer 19 acts as a supporting beam which has an upper surface shaped to support a wearer's foot comfortably. It cups the foot while providing substantial rigidity to the shoe bottom from just behind the ball of the foot, to the heel. The stabilizer may take on one of many cross-sectional shapes. FIG. 92 shows some of the shapes found useful. Note the wide top surface spreading the support across a large area of the foot. These cross-sectional views are taken through the heel of the stabilizer. The comfort stabilizer is wedge shaped and tapers toward the ball of the foot.

Figure 93:
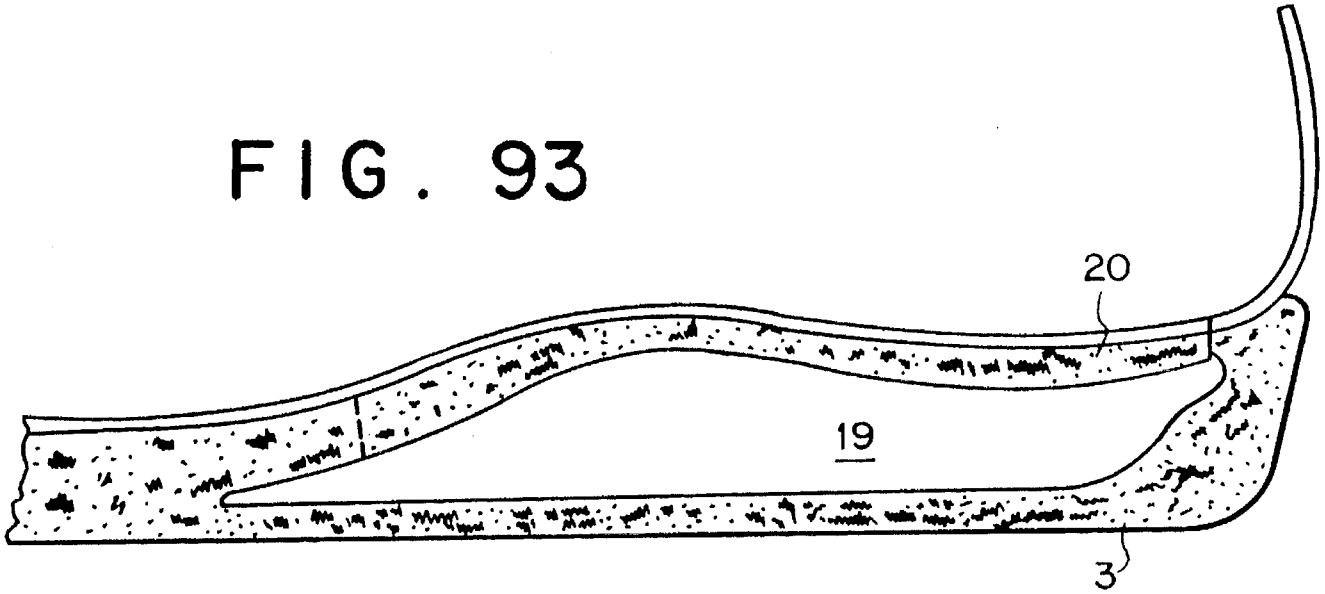
FIG. 93 is a longitudinal cross-section of a shoe bottom having the internal comfort stabilizer suspended.
Figure 95:
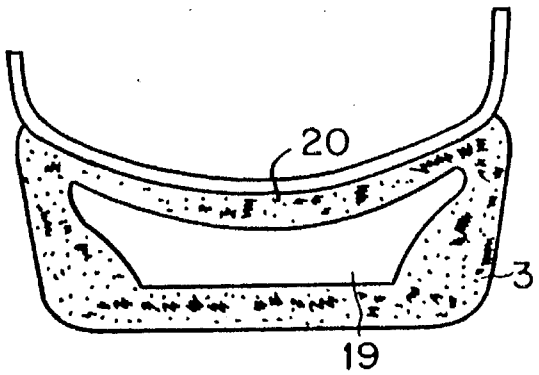
FIG. 95 is a transverse cross-sectional view along lines 95—95 of FIG. 93.
Figure 94:
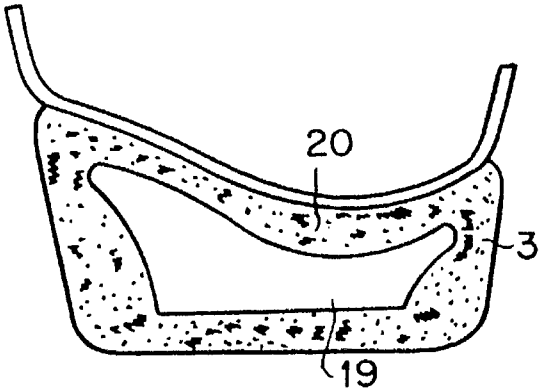
FIG. 94 is a transverse cross-sectional view along lines 94—94 of FIG. 93.

FIGS. 93–95 show the comfort stabilizer 19 in a shoe bottom of a single density PU. The stabilizer 19 is held in the mold by foam piece 20 which holds the stabilizer to the last. The stabilizer 19 is made of a hard material, therefor foam piece 20 also serves to cushion the stabilizer surface. Foam piece 20 may be made of shock foam or other shock absorbing material. Alternatively the sole may be molded without S-foam 20.

Figure 97:
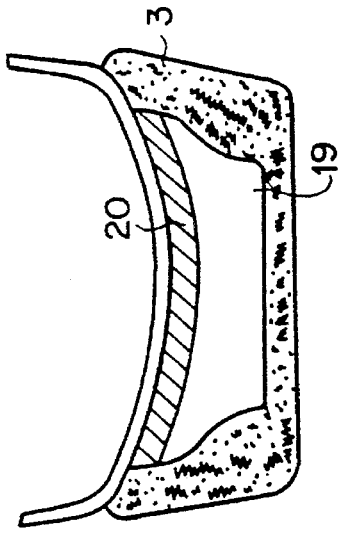
FIG. 97 is a transverse view of a shoe bottom having shock foam positioned above the internal comfort stabilizer.
Figure 96:
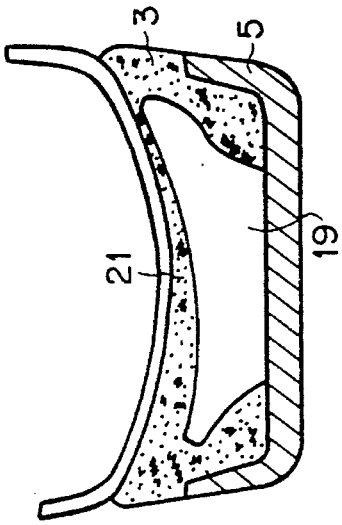
FIG. 96 is a transverse cross-sectional view of a shoe bottom with an internal comfort stabilizer for wearers with severe pronation problems.

FIGS. 96 & 97 show a stabilizer which is formed with an asymmetrical upper surface which is used for people who have a severe pronation problem. This type of stabilizer is useful for different types of running shoes. The stabilizer upper surface 21 may be shaped to provide additional support in areas required for a particular activity undertaken.

Figure 98:
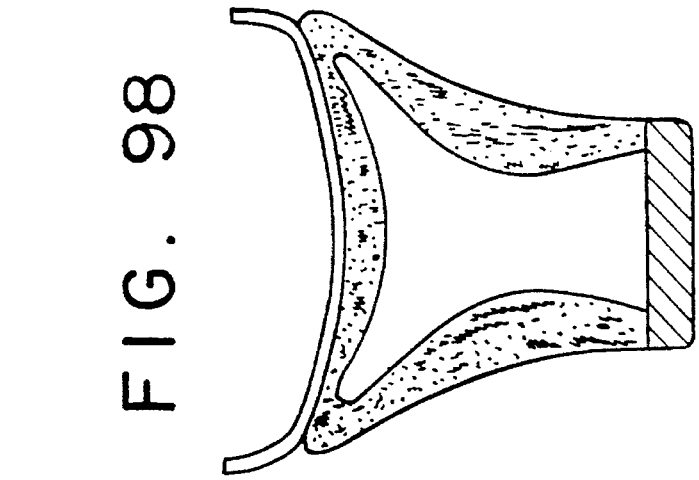
FIG. 98 is a transverse cross-section of a heel of a high heeled shoe with the internal comfort stabilizer of the invention.
Figure 99:
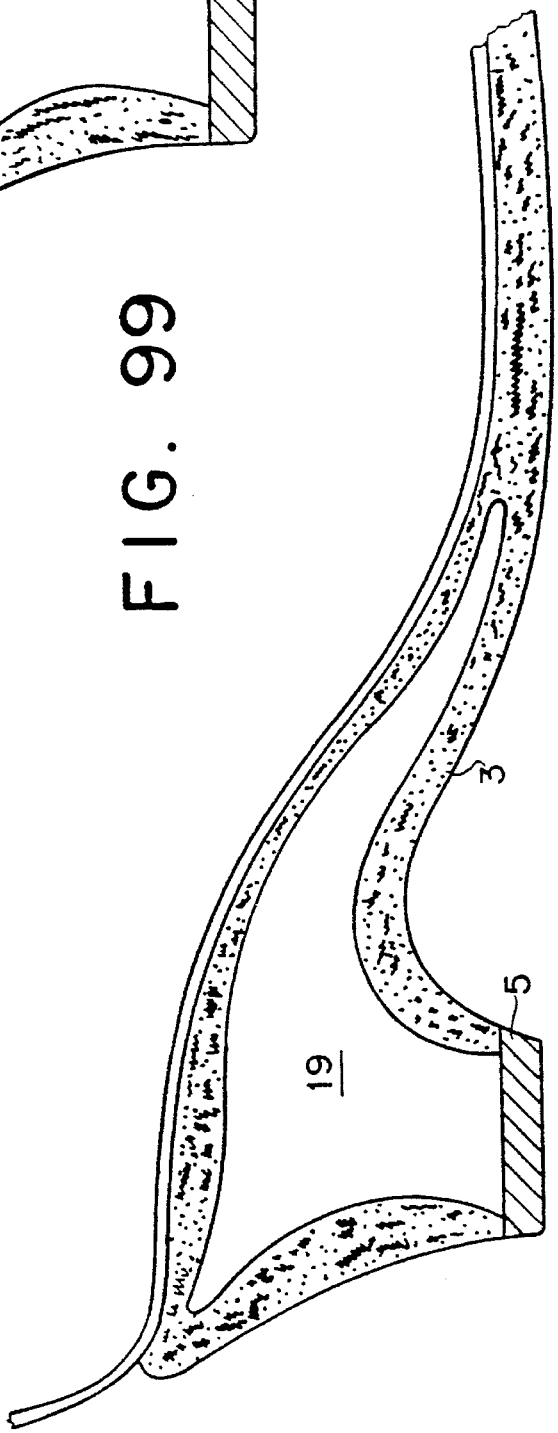
FIG. 99 is a longitudinal cross-section through the shoe bottom of FIG. 98.
Figure 100:
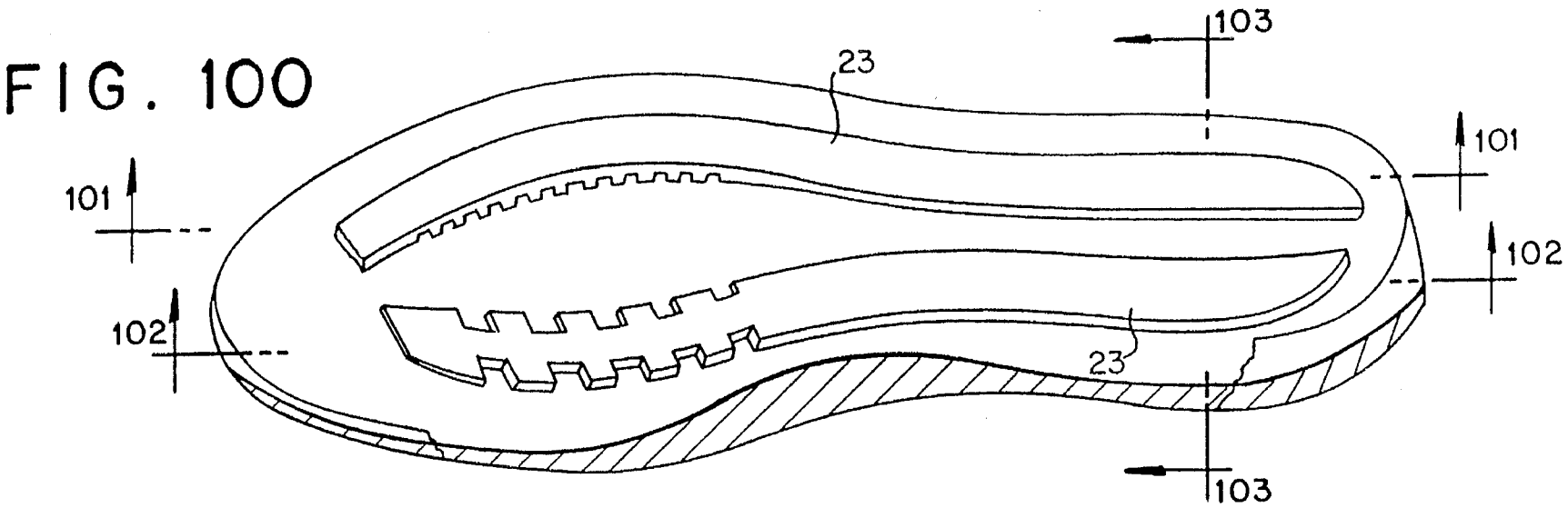
FIG. 100 is a perspective view partially broken away to show two alternate embodiments of stabilizers.
Figure 101:
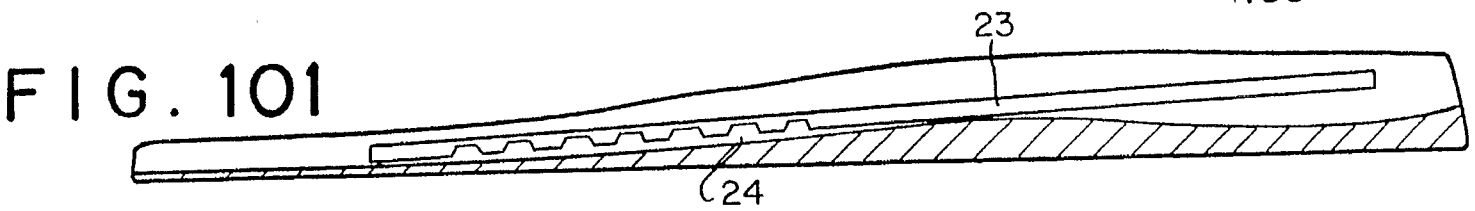
FIG. 101 is a longitudinal cross-section along lines 101—101 of FIG. 100.
Figure 102:
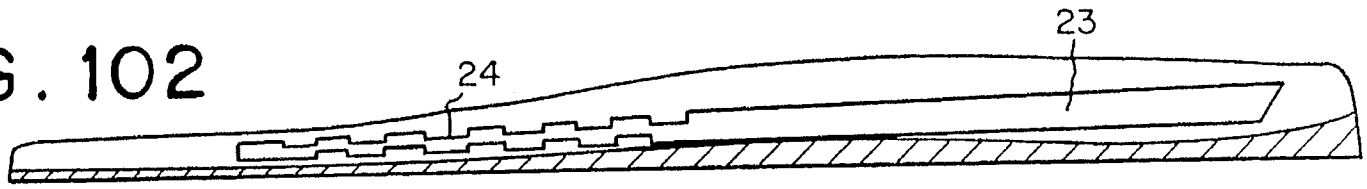
FIG. 102 is a longitudinal cross-section along lines 102—102 of FIG. 100.
Figure 103:
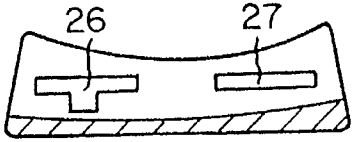
FIG. 103 is a transverse cross-section along lines 103—103 of FIG. 100.

FIGS. 98 & 99 show the stabilizer form which is used for high heeled shoes. The insert provides rigid support from the heel to the ball of the foot.

FIGS. 100–103 show a further embodiment of the stabilizer. Stabilizer bars 23 extend longitudinally within the shoe bottom. Grooves 24 or notches 25 (FIGS. 101 and 102) are provided in the area of the ball of the foot to permit the stabilizers to bend. The bars may have T-shaped cross-section 26 or may be flat as 27. The bars may taper slightly toward the ball of the foot.

Figure 104:
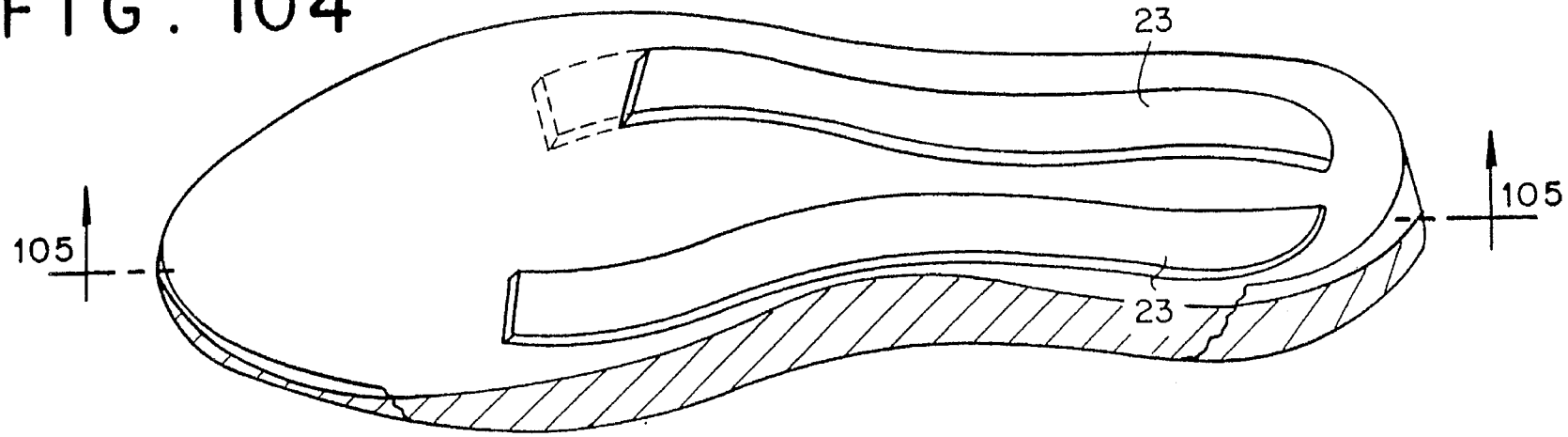
FIG. 104 is a perspective view, partially broken away, showing a further embodiment of the stabilizer of the invention.
Figure 105:
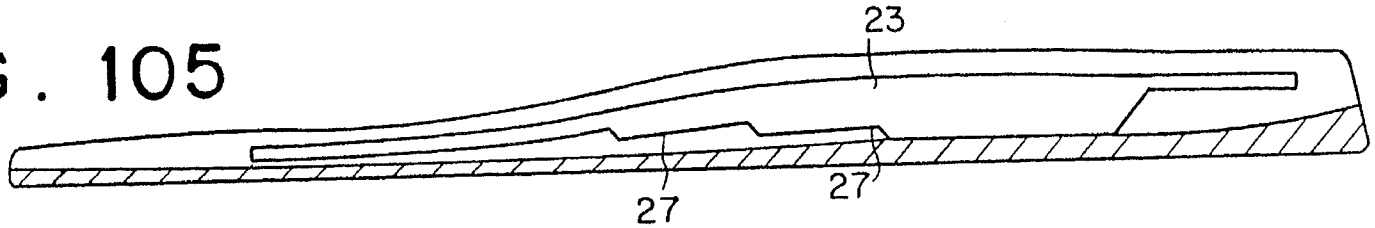
FIG. 105 is a longitudinal cross-section along lines 105—105 of FIG. 104.

FIGS. 104–105 show a stepped version of the stabilizer. Steps 27 are provided to change the thickness of the stabilizer.

Figure 106:
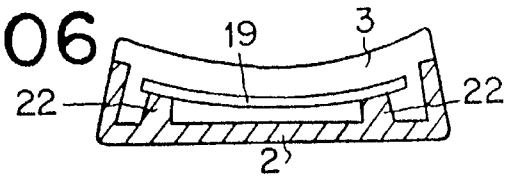
FIG. 106 is a transverse cross-section through the heel of a shoe bottom showing the mounting prongs.
Figure 111:
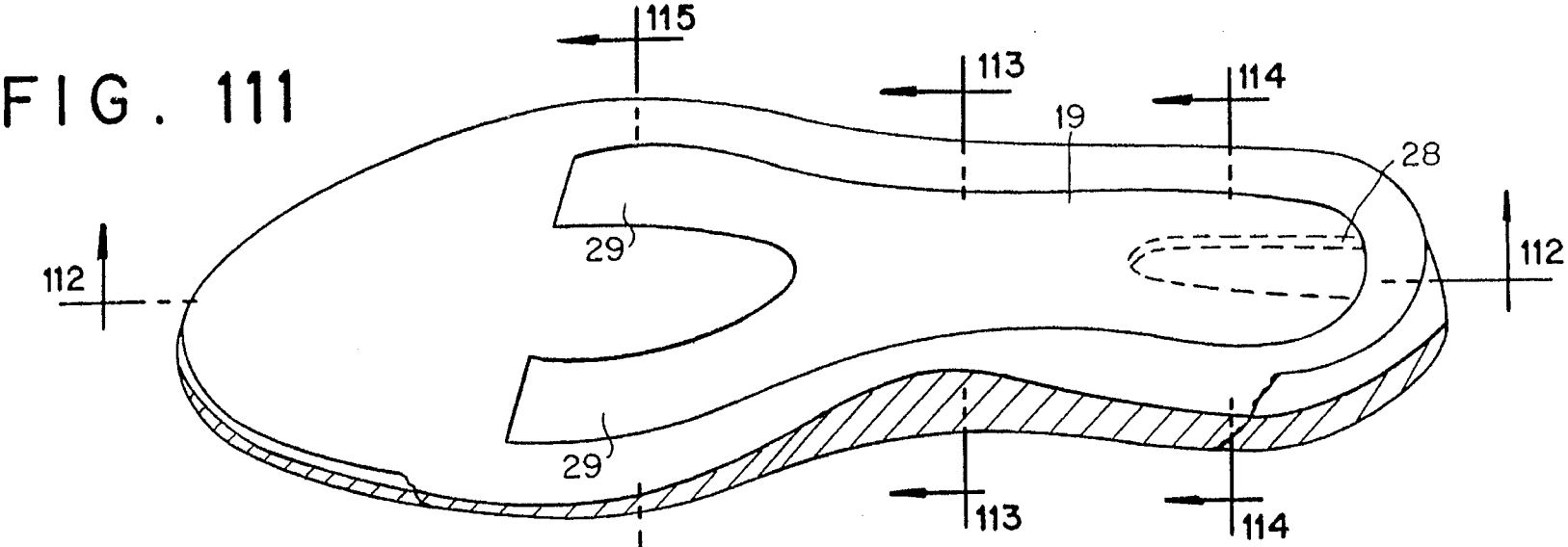
FIG. 111 is a perspective view showing a further embodiment of the stabilizer.
Figure 112:
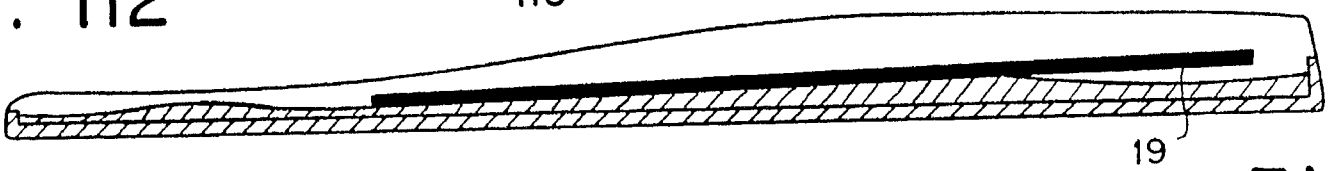
FIG. 112 is a longitudinal cross-section along lines 112—112 of FIG. 111.

FIG. 106 shows in more detail the protrusions 22 which are formed to extend upward from the lower layer. A stabilizer 19 is positioned on the protrusion and the upper layer is molded to surround the stabilizer.

FIGS. 107–110 shows stabilizer bars 23 which have two different shapes. The bars may be contoured 23A or straight 23B and may have a circular, semi-circular or rectangular shape as shown in FIG. 110.

Figure 116:
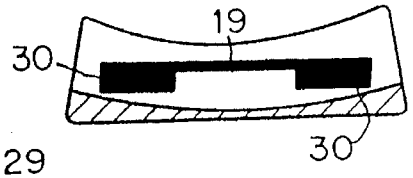
FIG. 116 is a transverse cross-sectional view showing an alternate embodiment of FIG. 114.
Figure 115:
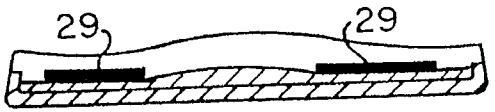
FIG. 115 is a transverse cross-section along lines 115—115 of FIG. 111.
Figure 114:
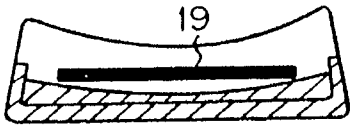
FIG. 114 is a transverse cross-section along lines 114—114 of FIG. 111.
Figure 113:
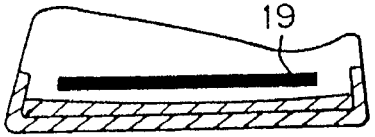
FIG. 113 is a transverse cross-section along lines 113—113 of FIG. 111.
Figure 117:
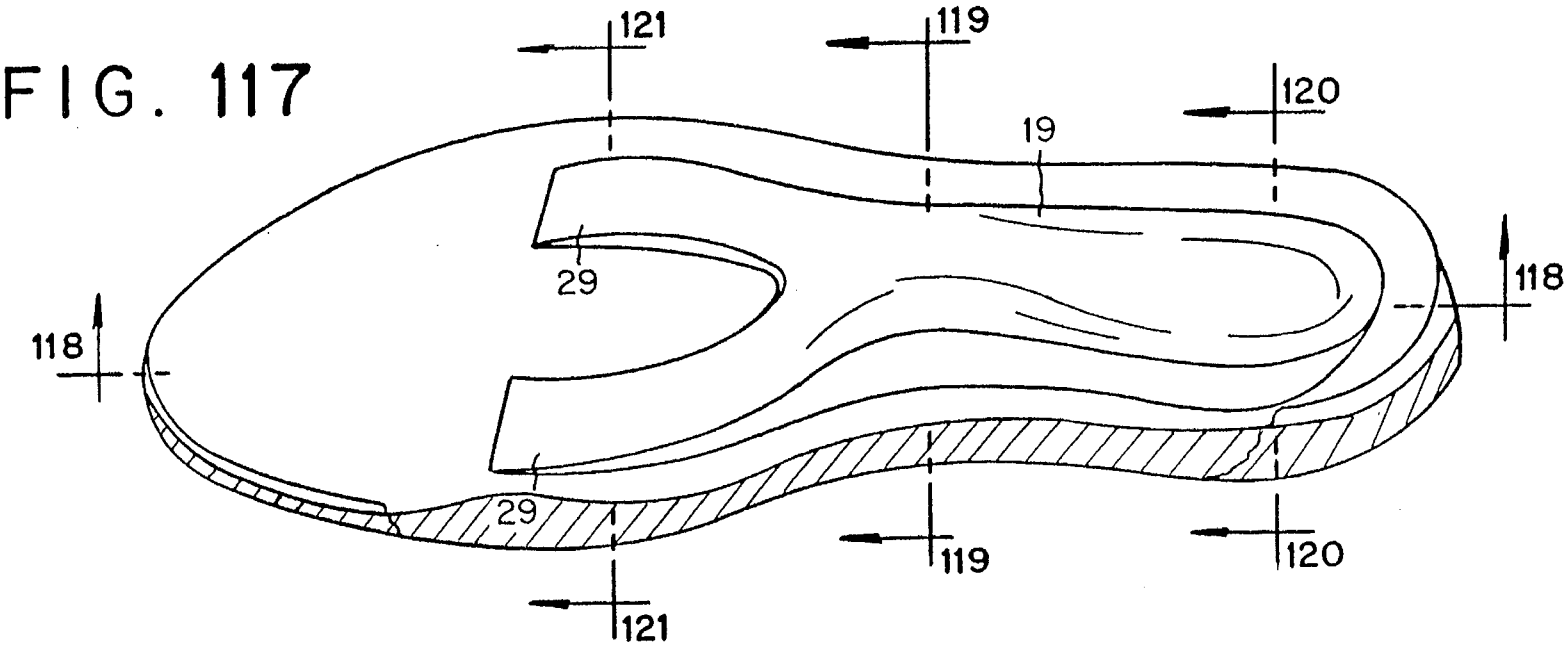
FIG. 117 is a perspective view, partially broken away, showing a further stabilizer.
Figure 118:
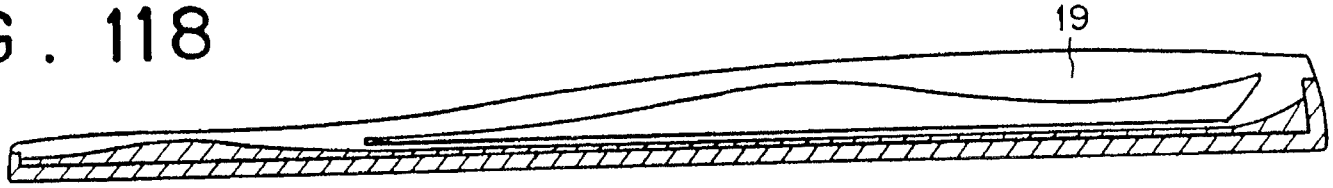
FIG. 118 is a longitudinal cross-section along lines 118—118 of FIG. 117.
Figure 119:
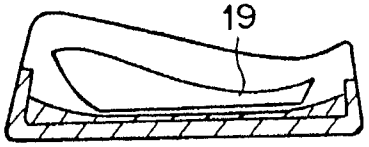
FIG. 119 is a transverse cross-section along lines 119—119 of FIG. 117.
Figure 120:
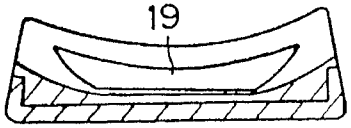
Figure 121:
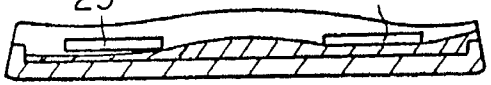
Figure 122:
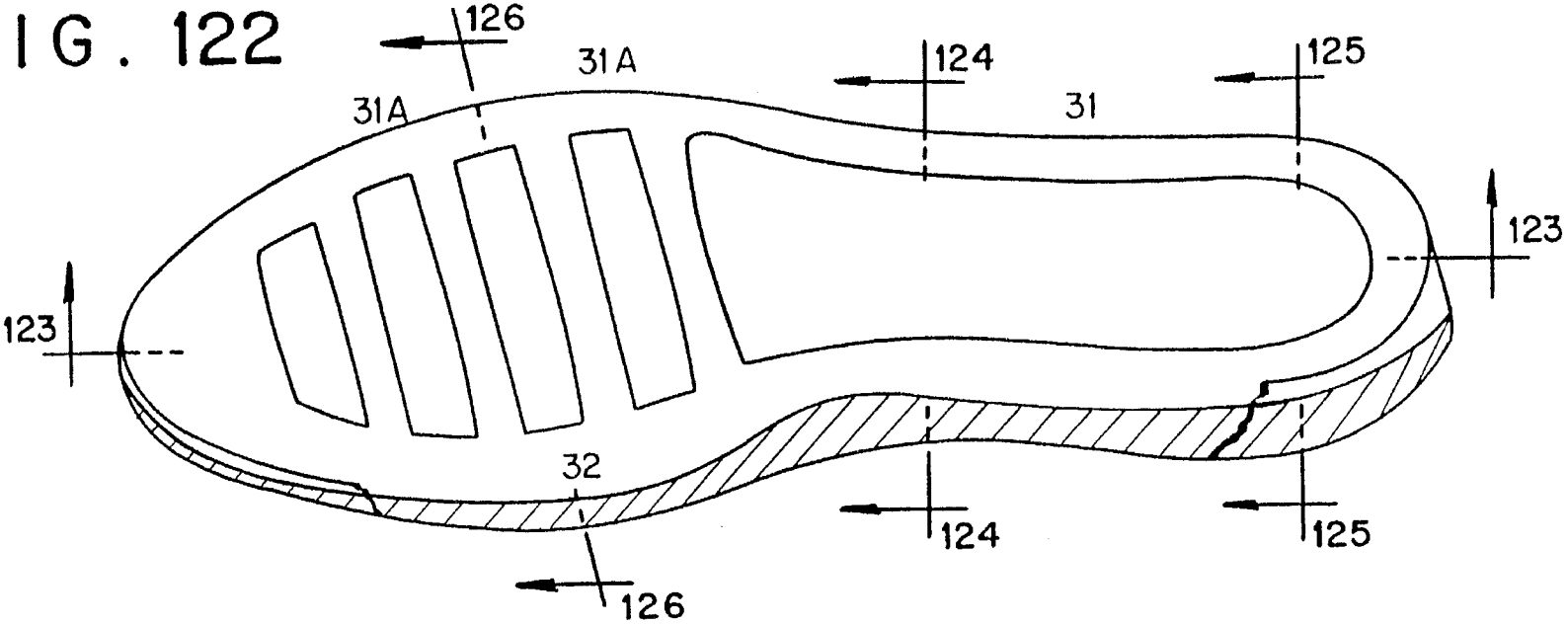
Figure 123:
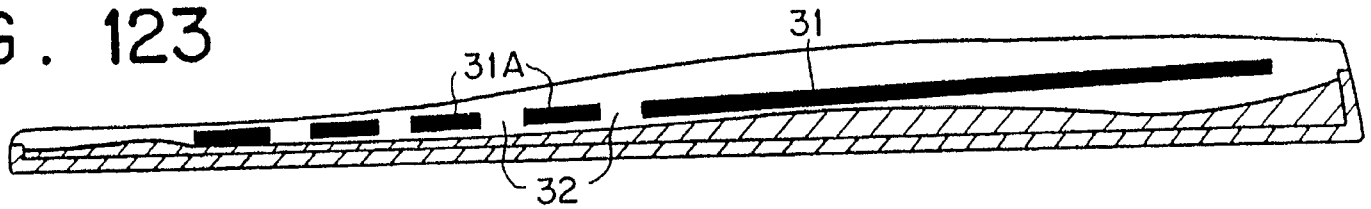
Figure 124:
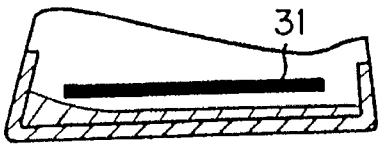
Figure 125:
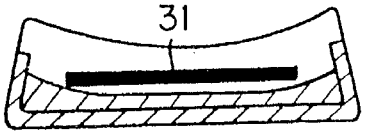
Figure 126:
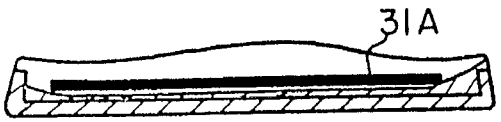
Figure 127:
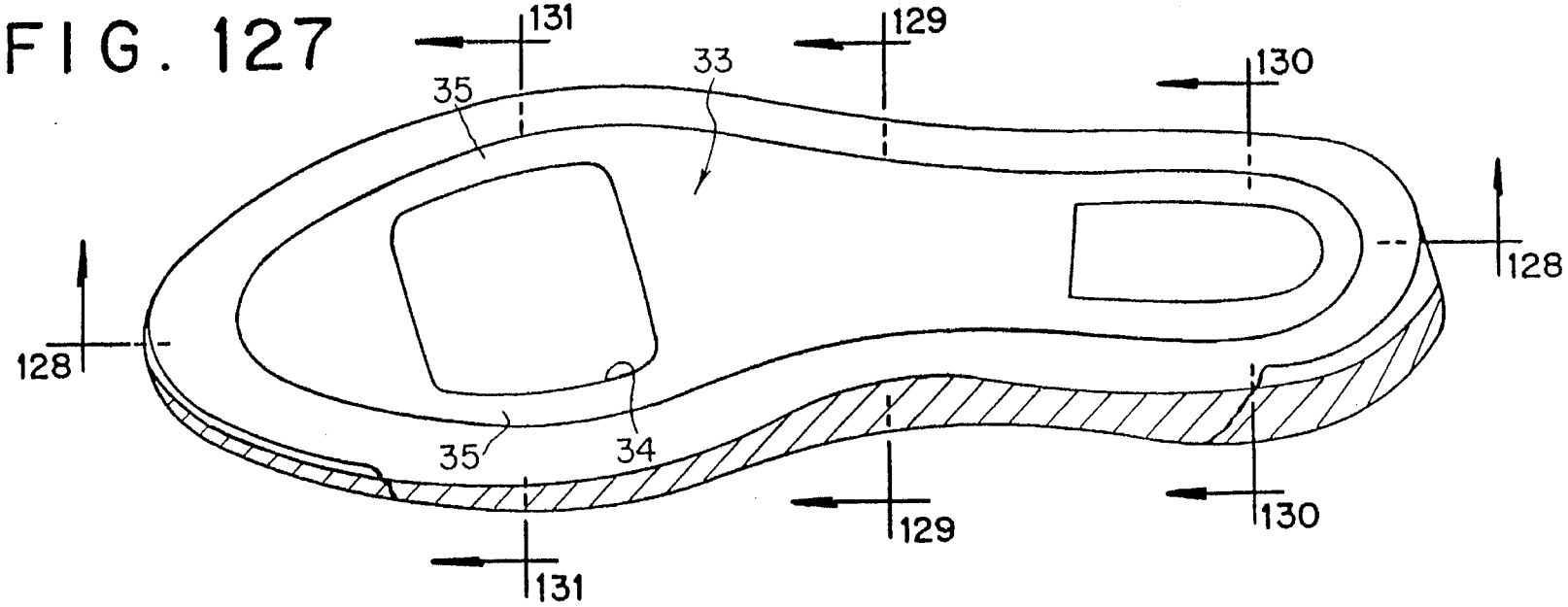
Figure 128:
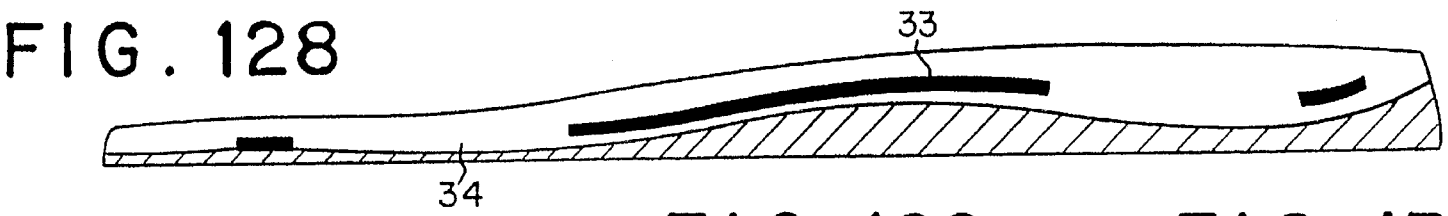
Figure 129:
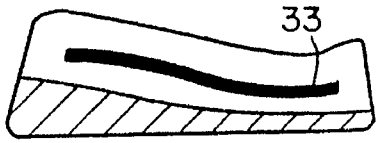
Figure 130:
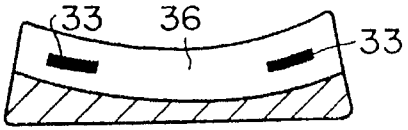
Figure 131:
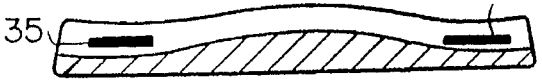

FIGS. 111–121 show a Y-shaped form of the stabilizer 19 which may have a heel cutout 28. The ball of the foot has arms 29 which support around the ball of the foot while cushioning the center. The stabilizer 19 may have a constant thickness (FIGS. 111–116) or may be contoured (FIGS. 117–121) with a shape to optimize the use of the body's natural cushioning. To provide additional support to the heel, portions are thickened at 30 as shown in FIG. 116.

The embodiment of FIGS. 122–126 provides lateral support to the ball of the foot while permitting flexing. Main bar 31 extends from the heel to just short of the ball of the foot. Flex bars 31A are separated by portions 32 of PU which permit the shoe bottom to flex. The foot sinks down into the PU in the portions 32.

A single piece stabilizer 33 is shown in FIGS. 127–131. The single piece is slightly flexible at the forefoot due to the cutout to form opening 34. Thin legs 35 permit the stabilizer to bend. Heel opening 36 permits forcing the heel's fatty tissue beneath the heel for cushioning. This type of stabilizer is best used in a shoebottom for a work shoe or hiking boot where a lot of flexibility is not required.

The stabilizer of FIGS. 132–136 must have some flexibility which reduces support, otherwise its application is in rugged foorwear where bending is not required.

Figure 138:
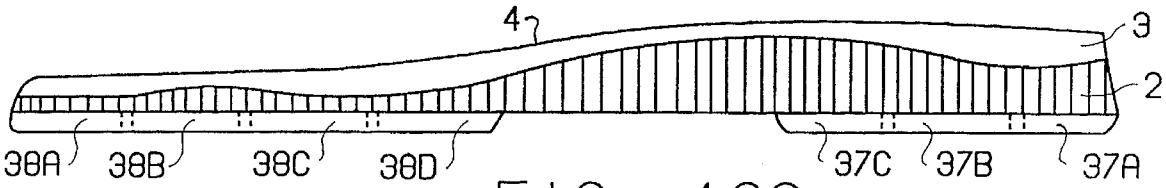

FIGS. 137–141 show another composite shoe bottom according to the invention. In this arrangement, the lower and upper layers are similar to that of FIGS. 1–5 and like components are numbered accordingly. In this embodiment, however, the outsole is formed of various pieces or strips of wear-resistant material, which may be placed adjacent each other with or without spaces between them. When these strips are spaced or contain a gap between them, the flexibility of the sole is enhanced. As shown in FIGS. 137 and 138, wear resistant outsole materials 37 and 38 are provided at least in the areas of the heel and beneath the ball of the foot in the toe portion. The material used for these outsole layers 37, 38 is preferably rubber or an abrasion-resistant polyurethane which is harder than the polyurethane of the upper or lower layers, or other similar materials. These outsole materials provide traction and abrasion resistance such that the shoe may have a relatively long useful life. When the outsole materials 37 and 38 are made of high density polyurethane, they can be integrally molded with the other layers. Otherwise, the outsole materials may be glued, ultrasonically welded or otherwise attached to the molded combination of the upper and lower layers.

It is not necessary for the outsole materials 37 and 38 to be used in complete pieces in this embodiment, as it is also contemplated that a series of strips of such materials 37A, 37B, 37C, 38A, 38B, 38C, 38D, as shown in FIG. 138, can be used. In this arrangement, some of the strips can be made of harder materials than the others for placement in the portions of the sole which experience the greatest degree of wear or abrasion. These strips can be applied horizontally as shown in FIG. 138 or vertically as shown in FIGS. 139 and 141. Also, although not shown in these FIGS., these strips can extend along the complete bottom of the lower layer to form a complete outsole. Also, spaces can be provided between these strips to increase the flexibility of the sole.

Another variation of the invention is shown in FIGS. 137–141, wherein the lower layer extends completely around and surrounds the upper layer. In this arrangement, the greatest degree of lateral support is provided to both the upper layer and the user's foot. Furthermore, when the lower layer 2 is made of a relatively harder polyurethane material that has abrasion resistant properties, it may be molded to a form which would include pieces 37 and 38. In addition, it is possible to mold only certain strips (e.g., 38B, 38D, 37A) to be of a harder rubber, polyurethane or like material. The remaining strips or pieces of the sole can then be glued or otherwise attached to the lower layer. If desired, the harder materials can be first provided on the lower surface of the lower layer in the appropriate locations, and the remainder of the outsole can be formed by molding a different polyurethane into the spaces between the harder materials.

FIG. 142 illustrates another way in which the sole portion 38 can be made with strips of different hardness materials. For example, portion 41, a peripheral band, can be made of the hardest material to facilitate the wear resistance of the shoe as it is worn and used, whereas portion 40 could be made of a slightly softer material to provide additional cushioning and suitable wear resistance. Portion 42 which does not experience anywhere near as much abrasion or wear as portions 40 and 41 can be made of a softer material for even greater cushioning of the foot. Similarly, in FIG. 143, portion 45 can be made of the hardest and most wear resistant material used in the sole, since this area experiences the greatest stress and wear. Also, portion 44 can be made of a slightly softer wear-resistant material since abrasion and stress at that point is less. Portion 46 again can be a softer material for cushioning of the foot and for absorbing impact or shock while running, playing sports or conducting other strenuous activities. Different levels of effective cushioning can also be achieved by varying the thickness of the strips. In yet another embodiment, the hardest or thickest strips can be provided in the areas which will experience the highest degree of abrasion or wear, and the remainder of the outsole can be molded around the strips, i.e., in the gaps and spaces between the strips and the balance of the bottom side of the sole. If desired, threads or grooves may also be provided to facilitate traction or flexibility when the shoe is worn. These threads or grooves would typically be situated between the wear strips.

FIGS. 144 and 145 illustrate another embodiment of the invention wherein the upper layer 44 is formed with a recessed portion 49 in the shape of the bottom of the user's foot, whereas the lower layer 45 may be similar to other embodiments. In this version, however, the forward end of the lower layer 45 extends to the front portion of the shoe to form a toe guard 46 and the rearward end of the lower layer 45 extends to the rear portion of the shoe to form a heel guard 47. As noted above, it is preferred to mold the upper and lower layers together since this forms a unitary structure. When gluing or other means of adhesively attaching the layers is used, grooves 48 may be provided on the upper surface of the lower layer for engagement with corresponding ribs positioned in the lower surface of the upper layer. These grooves 48 assure that the layers are in proper mating engagement when being attached by the adhesive so that the layers are positioned correctly with respect to each other in the final construction of the shoe sole. In addition, these grooves would increase the flexibility of the sole by providing lateral depressions which can bend more easily than a solid structure.

FIGS. 146–148 illustrate a women's high heel shoe in accordance with the invention. This shoe is formed of a molded body component 50, preferably of a polyurethane material, which has a last 51 secured to the top thereof and which optionally encloses a stabilizer 52 therein. The outsole is formed of various pieces or strips of wear-resistant material. For example, wear resistant outsole materials 53 and 54 are provided at least in the areas of the heel and beneath the ball of the foot in the toe portion. The material used for these outsole layers 53, 54 is preferably rubber or an abrasion-resistant polyurethane which is harder than the polyurethane which is used for the body component 50. As noted above, outsole materials which provide traction and abrasion resistance are used so that the shoe may have a relatively long useful life. These outsole materials can be made of high density polyurethane and integrally molded or can be made of other materials and glued, ultrasonically welded or otherwise attached to the body component.

As described above, it is not necessary for the outsole materials 53 and 54 to be used in complete pieces in this embodiment, as it is also contemplated that a series of strips of such materials, applied horizontally, vertically, or in patterns can be selected to provide the optimum performance of the shoe in the desired wearing environment. Although the outsole materials are shown as being flat, they can be provided with contours, grooves or threads to increase the flexibility and traction of the sole, if desired.

FIGS. 149–157 illustrate a double contour, double density ladies' dress shoe 60 which is constructed in accordance with the present invention. Specifically, this shoe includes a lower support layer 62, which can be made in one piece as shown from a plastic or rigid foam material, and an upper 64. The lower support layer 62 must be made of a sufficiently rigid material to provide the necessary support to span the areas between the user's heel and toes. Thus, the stiffness and hardness of the material must be tailored to the type of shoe, with the higher spike heels requiring a stiffer material than would be used for shoes having low or moderate height heels. The lower support layer 62 may also include an outsole of a relatively harder, wear resistant material as a single layer covering the entire bottom surface of layer 62 or in the form of a series of strips positioned at least beneath the ball and toe area as well as beneath the heel area, as shown in the embodiment of FIG. 146.

The construction of the lower support layer 62 and the various upper layers which may be positioned upon it are shown in FIGS. 150–152. The lower support layer 62 of FIG. 150 includes an integral heel for strength, and has an upper surface which is slightly contoured in the heel area, preferably by being slightly raised along the outer perimeter to provide cushioning to the heel of the user. The remaining upper surface of layer 62, i.e., the toe and instep portions, may be flat or may include raised areas as shown, e.g., in FIGS. 1–5, for additional cushioning and support for the user's foot. Upon the upper surface of layer 62 is provided a foam layer 66, which, as shown in other FIGS., preferably has an uppermost surface which is contoured to be complemental to the foot of the user. This layer 66 is made of a material which is softer than that of the lower layer 62. For example, the lower layer could be made of a polyurethane having a Shore A hardness of about 60 to 90 or higher, while the upper layer could be made of a softer polyurethane having a Shore A hardness of about 40 to 60. If desired, the upper surface of foam layer 66 can be configured to include a raised portion in the toe area, a cupped heel area and an instep arch for additional cushioning and support of the user's foot. However, by contouring the upper surface of the lower support layer 62, only a single upper foam layer would be needed to provide sufficient support and cushioning to the user's foot.

Instead of lower support layer 62, a conventional lasting board made of heavy paper, cardboard or another fairly rigid material, can be used as the support surface for the shoe. A single piece foam layer, which is similar to upper layer 66 described above, is then attached to this board, along with an upper 64 and an outsole. This single piece foam layer may be contoured as described above with regard to foam layer 66, and the upper surface is preferably configured to be complemental to the user's foot. This foam layer may have also have different densities to provide different levels of cushioning to different portions of the wearer's foot. If desired, a covering can be placed upon the top surface of the foam layer. This covering, which may be made of leather, camprelle or soft polyurethane, is commonly referred to as a sock liner. Thus, the entire shoe can be constructed from a minimum number of components, while also providing a high level of comfort and cushioning to the user's foot.

FIG. 151 illustrates an embodiment which is similar to that of FIG. 150, except that the rigid support layer 62 does not include an integrally molded heel. Instead, a separate heel made of a rigid thermoplastic material is attached to the layer 62. The upper surface of the support layer 62 and the foam layer 66 could be configured in the same manner as described above in FIG. 150.

The embodiment of FIG. 152 is similar to that of FIG. 151 except that shock foam inserts 72 are included beneath the toe and heel portions of foam layer 66. These shock foam inserts 72 are made of an impact absorbing foam and are provided for shoes which will experience relatively heavy or large shock forces, such as would typically occur during extended walking, running, jumping or other strenuous physical exercises. This construction provides the greatest degree of comfort when the shoe is used for those purposes.

FIGS. 153 and 154 illustrate the attachment of the upper 64 to the support layer 62 in the heel area for the shoes of FIGS. 151 and 152, respectively, while FIG. 154 further illustrates the positioning of the shock foam insert 72 in the heel area for the shoe of FIG. 153. In these FIGS., an outsole 74 is shown on the bottom surface of the heel.

FIG. 155 illustrates the forefoot area of the shoe of FIG. 150 in cross-section to detail the attachment of the upper 64 to the support layer 62. An outsole 74 is also shown. In FIG. 156, a slightly different configuration is provided for the support layer 62, in that it has a raised perimeter 78 and a relatively flat inner area 76. In this arrangement, the raised perimeter portions 78 provide support for the perimeter of the user's foot, as well as room for attachment of the upper 64. It is desirable for this type of shock foam insert to be utilized with an upper foam layer that has a raised portion in the toe area, as shown in FIG. 156. Also, the arch and heel areas of the upper foam layer 66 can also be raised or contoured to provide an upper surface which is complementary to the foot of the user. FIG. 157 illustrates the positioning of the shock foam insert 72 in the toe area for the shoe of FIG. 152 as well as the attachment of the upper 64 and outsole 74 to the support layer 62.

Having thus clearly described our invention in a manner which is fully understandable to persons skilled in the art, it is intended that the appended claims cover the preferred embodiments as well as any and all modifications which may be devised by such persons but which would fall within the true spirit and scope of the present invention.

We claim:

1. A composite shoe bottom having a toe area, arch area and heel area comprising:

a) a lower shaped layer of a material having a predetermined hardness and having a cross-sectional thickness which is increased around the periphery of the heel area and in the medial portion of the arch area to form a raised heel periphery and raised arch support and an irregular contoured upper stabilizing surface for the wearer's foot; and b) an upper cushioning layer of a material which is softer than the material of the lower layer and is superposed in face-to-face relation upon the upper surface of the lower layer, said upper layer having a varying thickness which is pre-shaped to a three-dimensional contour having an uppermost surface which is complementary to the bottom surface of the wearer's foot and an increased height around the periphery of the heel area and in the arch area, with the three dimensional contour in the arch area having a side-to-side height profile that varies along an arcuate path from a relatively lower point on the lateral portion of the layer to a relatively higher point on the medial portion of the layer to form a raised arch support, thereby providing an irregular contoured upper stabilizing surface for the wearer's foot;

wherein the increased thickness of the lower layer in the heel area is positioned directly beneath the upper layer, the increased thickness of the raised arch support of the lower layer is positioned directly beneath the arch support of the upper layer, and the material of the upper and lower layers can flex, move and distort under the weight of the wearer without permanent deformation.

2. The composite shoe bottom according to claim 1 wherein:

a) the lower layer has a heel area which is cup shaped to provide support to a heel of a wearer, and which forces fatty tissue of the heel of a wearer beneath the heel for cushioning of the heel.

3. The composite shoe bottom according to claim 1 wherein:

a) the lower layer has an upstanding rim along its periphery which surrounds at least a portion of the upper layer to provide lateral support to said upper layer.

4. The composite shoe bottom according to claim 1 wherein:

a) an outsole of wear-resistant material is attached beneath the lower layer to provide greater traction for the shoe bottom and protection against abrasion.

5. The composite shoe bottom according to claim 4 wherein:

a) the outsole extends up sides of the lower layer.

6. The composite shoe bottom of claim 1 wherein the toe area is positioned beneath the wearer's toes and the thickness of at least one of the upper or lower layers in the toe area decreases from a central portion to an outer periphery thereof.

7. The composite shoe bottom of claim 6 wherein each of the upper and lower layers in the toe area decreases from the central portion to the outer periphery thereof.

8. The composite shoe bottom of claim 1 wherein the lower layer comprises an outsole.

9. The composite shoe bottom of claim 1 further comprises at least one stabilizing insert for providing greater support to the wearer's foot.

10. The composite shoe bottom of claim 1 further comprising an internal comfort stabilizer for providing additional cushioning to the wearer's foot.

11. The composite shoe bottom of claim 1 wherein the lower layer includes a lateral support rim which surrounds the upper layer at least in the heel area.

12. The composite shoe bottom of claim 1 wherein the lower layer includes a lateral support rim which surrounds substantially the entire upper layer.

13. The composite shoe bottom of claim 1 further comprising at least one shock absorbing insert located in areas of the shoe bottom which will be subjected to the greatest shock when the shoe bottom is worn.

14. The composite shoe bottom of claim 13 wherein a shock absorbing insert is located in at least one of the heel or toe areas.

15. The composite shoe bottom of claim 13 wherein shock absorbing inserts are located in each of the heel and toe areas.

16. The composite shoe bottom of claim 8 wherein the outsole comprises at least one strip of a wear resistant material which is positioned beneath the heel area of the lower layer.

17. The composite shoe bottom of claim 16 wherein the at least one strip is configured and positioned to extend along at least a portion of the periphery of the heel area.

18. The composite shoe bottom of claim 16 wherein a first strip is positioned adjacent the toe area beneath the ball of the wearer's foot and a second strip is positioned in the heel area beneath the user's heel.

19. The composite shoe bottom of claim 16 wherein a plurality of strips of wear resistant material are used, wherein some of the strips are softer than the others to provide shock absorption to the upper and lower layers.

20. The composite shoe bottom of claim 16 wherein a plurality of strips of wear resistant material are used, wherein some of the strips are thicker than the others to provide shock absorption to the upper and lower layers.

21. The composite shoe bottom of claim 19 wherein an outsole-forming material is applied to the lower surface of the lower layer in areas which are not covered by the at least one strip to form an outsole which is contiguous with the lower surface of the lower layer.

22. The composite shoe bottom of claim 21 wherein the outsole extends to the upper layer along at least one side of the lower layer.

23. The composite shoe bottom of claim 16 wherein an outsole is formed from a plurality of the strips.

24. The composite shoe bottom of claim 23 wherein a portion of the outsole extends to the upper layer along the forward end of the lower layer.

25. The composite shoe bottom of claim 23 wherein a portion of the outsole extends to the upper layer along the rearmost end of the lower layer.

26. The composite shoe bottom of claim 23 wherein portions of the outsole extend to the upper layer along the forward and rearmost ends of the lower layer.

27. The composite shoe bottom of claim 18 wherein the first strip covers the toe area of the lower layer and the adjacent area beneath the ball of the user's foot, and the second strip covers the heel area of the lower layer.

28. The composite shoe bottom of claim 27 wherein the first strip is spaced apart from the second strip.

29. The composite shoe bottom of claim 1 wherein the lower layer further comprises a raised perimeter portion at least in the heel area which portion extends to the upper surface of the upper layer for providing additional support for the user's foot.

30. The composite shoe bottom of claim 29 wherein the lower layer further comprises a raised perimeter portion at least in the heel and toe areas which portion extends to the upper surface of the upper layer for providing additional support for the user's foot.

31. The composite shoe bottom of claim 29 which further comprises at least one shock absorbing insert positioned beneath the heel or toe area.

32. The composite shoe bottom of claim 29 which further comprises a shock absorbing insert beneath each of the heel and toe areas.

33. The composite shoe bottom of claim 31 wherein the shock absorbing insert is positioned upon the lower layer and is not covered by the upper layer.

34. The composite shoe bottom of claim 1 wherein the thickness of the lower layer in the toe area decreases from a central portion to the sides thereof.

35. The composite shoe bottom of claim 34 wherein the lower layer is preshaped to a three-dimensional contour which includes an increased thickness in the periphery of the heel area and a side-to-side thickness profile that varies along an arcuate path from a relatively higher point around the periphery of the heel area to a relatively lower point near the center of the heel area to provide support for the user's heel.

36. The composite shoe bottom of claim 11 wherein the lower layer is preshaped to a three-dimensional contour which includes an increased thickness in the periphery of the heel area and a side-to-side thickness profile that varies along an arcuate path from a relatively higher point around the periphery of the heel area to a relatively lower point near the center of the heel area to provide support for the user's heel, wherein the periphery of the heel area extends to said lateral support rim.

37. The composite shoe bottom of claim 12 wherein the lower layer is preshaped to a three-dimensional contour which includes an increased thickness in the periphery of the heel area and a side-to-side thickness profile that varies along an arcuate path from a relatively higher point around the periphery of the heel area to a relatively lower point near the center of the heel area to provide support for the user's heel, wherein the periphery of the heel area extends to said lateral support rim.

38. The composite shoe bottom of claim 1 wherein the lower layer is preshaped to a three-dimensional contour which includes an increased thickness in the periphery of the heel area and a side-to-side thickness profile that varies along an arcuate path from a relatively higher point around the periphery of the heel area to a relatively lower point near the center of the heel area to provide support for the user's heel.

39. The composite shoe bottom of claim 1 where in the three dimensional contour of the upper cushioning layer has a side-to-side thickness profile that varies from a relatively thicker section on the medial portion of the layer to a relatively thinner section on the lateral portion of the layer.

40. The composite shoe bottom of claim 1 wherein the three-dimensional contour of the upper cushioning layer has an increased thickness around the periphery of the heel area.

* * * * *